US006339692B2

(12) United States Patent
Yoshida et al.

(10) Patent No.: US 6,339,692 B2
(45) Date of Patent: Jan. 15, 2002

(54) PRINTER FOR CONTINUOUS FORMS WITH MOISTURE ADJUSTMENT

(75) Inventors: Hiroaki Yoshida; Masato Matsuzuki, both of Kawasaki; Katsumi Adachi, Hyogo; Yoshikazu Yamamoto, Kawasaki; Daisuke Fujii, Kawasaki; Takashi Inui, Kawasaki; Yukitoshi Takano, Kawasaki, all of (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/745,994

(22) Filed: Dec. 26, 2000

(30) Foreign Application Priority Data

Dec. 27, 1999 (JP) ..... 11-371252
Sep. 29, 2000 (JP) ..... 12-297820

(51) Int. Cl.[7] ..... G03G 15/20; G03G 15/00
(52) U.S. Cl. ..... 399/384; 399/67; 399/390
(58) Field of Search ..... 399/67, 341, 384, 399/390, 94, 97

(56) References Cited

U.S. PATENT DOCUMENTS 5,835,936 A * 11/1998 Hirao ..... 399/336
6,232,998 B1 * 5/2001 Tokairin et al. ..... 347/234

FOREIGN PATENT DOCUMENTS

| | | |
|---|---|---|
| JP | 57-125960 | 8/1982 |
| JP | 1-97979 | 4/1989 |
| JP | 4-168467 | 6/1992 |
| JP | 5-53474 | 3/1993 |
| JP | 9-110269 | 4/1997 |
| JP | 11-194684 | * 7/1999 |

* cited by examiner

*Primary Examiner*—Joan Pendegrass
(74) *Attorney, Agent, or Firm*—Armstrong, Westerman, Hattori, McLeland & Naughton, LLP

(57) ABSTRACT

This invention relates to a printing device that performs fixation after transfer, and which prevents the occurrence of no transfer even when feeding the paper backward starting printing from the next page after the final page. This printing device comprises image-formation units (3, 4) that transfer a toner image, a fixation unit (5), and a control unit (10). The control unit (10) control adjustment of the moisture content on either the final page or leading page. In order to do that, it lowers the fixation energy of the fixation unit (5) for the final page. There is a moisture-adjustment mechanism (16) that reduces the moisture content of the leading page. Heat energy is applied to the leading page by the fixation unit (5). This reduces the difference in the amount of shrinkage between the final page and the leading page, and prevents wrinkling of the leading page.

19 Claims, 26 Drawing Sheets

FIG. 14

| | FIXATION RATE(%) | | DISTORTED PRINT(135KG) | | |
|---|---|---|---|---|---|
| FV VOLTAGE | 55KG | 135KG | a)SCUFF | b)FOLD | c)FOLLOW UP ROLLER |
| 1650V | 97 | 95 | OK | OK | OK |
| 1550V | 73 | 68 | OK | OK | OK |
| 1450V | 60 | 60 | NG | OK | OK |
| 1350V | 47 | 38 | NG | OK | NG |

| | DOT SIZE (REAL SIZE OF 5×5 mm BLOCK) | TOTAL DOT NO. OF 5×5 mm BLOCK | RESOLUTION CO-EFFICIENT | DOT DENSITY FOR CALCULATION |
|---|---|---|---|---|
| 240 dpi | 48×48 (5.08×5.08 mm) | 2304 | 80/3 | 0 ~ 61440 |
| 400 dpi | 80×80 (5.08×5.08 mm) | 6400 | 48/5 | 0 ~ 61440 |

$Sum_x$:ONE DIRECTION ARRANGEMENT OF CALCULATION RESULT
$L_i$ :WEIGHT FOR SUB SCAN DIRECTION
$D_{x,i}$ :5mm DOT DENSITY $$Sum_x = \sum_{i=0}^{39} (L_i \times D_{x,i})$$

$Tsm_x$ :WRINKLING VALUE
$W_i$ :WEIGHT FOR MAIN DIRECTION
$Sum_x$ :SUB SCAN CALCULATION RESULT $$Tsm_x = \sum_{i=0}^{39} (W_i \times Sum_x)$$

PRINTER FOR CONTINUOUS FORMS WITH MOISTURE ADJUSTMENT

BACKGROUND OF THE INVENTION

1. Field of the Invention

This invention relates to a printing apparatus and printing method for positioning the next printing area to the image formation unit after the last printing area of the previous printing instruction has been fixed, and more particularly to a printing apparatus and printing method for reducing wrinkling of the recording medium.

2. Description of the Related Art

Printing apparatus are widely used as output devices for computers. Electronic photographic devices, which are capable of printing on the normal paper, are used as such a printing device. In recent years, with the increase in speed and capacity of host systems, electronic photographic printing devices that are capable of printing large quantities of data at high speed are desired. Therefore, electronic photographic printing devices that print on continuous paper, which can be continuously fed, are being provided.

FIG. 33 is a drawing explaining the prior art. Is shows an electronic photographic type, continuous-paper printing device. In the electronic photographic printing device, a toner image, that is developed on the photoconductive drum, is transferred to the paper, then the transferred toner image is fixed and the printing process is finished.

This electronic photographic type continuous-paper printing device is explained for a printing device that prints both surfaces of the paper. As shown in FIG. 33, the double-side printing device comprises: a printing unit 101 that prints the top surface of continuous paper 100, and a printing unit 102 that prints the back surface of the continuous paper 100. The continuous paper 100 has machine perforations on every page. The printing unit 102 for the back surface has a photoconductive drum 90. The photoconductive drum 90 is electrically charged by a pre-charger that is not shown in the drawing, then it is exposed with the light image by an exposure device that is not shown in the drawing. By doing this, an electric latent image that corresponds to the light image is formed on the photoconductive drum 90. And the electric latent image on this photoconductive drum 90 is developed by toners with a developing device that is not shown in this figure. And then the toner image on this photoconductive drum 90 is transferred to the continuous paper 100 by a transfer device 91. Printing the back surface of the continuous paper 100 is performed in this way.

The top surface of the continuous paper 100 is printed in a similar manner. In other words, the printing unit 101 for the top surface also has a photoconductive drum 92. The photoconductive drum 92 is electrically charged by a pre-charger (not shown in the drawing), and then is exposed with light image by an exposure device that is not shown in the drawing. By doing this, an electric latent image that corresponds to the light image is formed on the photoconductive drum 92. And the electric latent image on this photoconductive drum 92 are developed by toners with a developing device not shown in this figure. And then the toner image on this photosensitive drum 92 is transferred to the continuous paper 100 by a transfer unit 93. Printing the top surface of the continuous paper 100 is performed in this way.

Next, the toner images on both surface of the paper 100 are fixed by a fixing unit 94. This fixing unit 94 uses various methods for fixing the toner. For example, there is a heat-roller method that moves the paper with a high-temperature heat roller and fixes the toner with heat, or there is a flash fixing method that uses a flash lamp to irradiate the paper with a high-energy light that melts and fixes the toner. This kind of electric photographic type double-side printing device for printing on continuous paper has been discloses in Japanese Unexamined published patent No. 7-77581, or Japanese Unexamined published patent No. 8-211664.

With this kind of continuous-paper printing device, the transfer position of the toner image and the fixing position are separated. Therefore, if the last printed page 110 of one printing job stops in an un-fixed state when one printing job is finished printing, the un-fixed image could be blurred due to various causes. Therefore, when a 'Stop Printing' command is received, it is not advisable to stop feeding paper when there are still unfixed pages.

Therefore, before printing operation is stopped, the transferred pages are fed and fixed by the fixing unit 94. In other words, the last printed page 110 of the job is positioned in fixing unit 94. At this time, the next page 111 after the last printed page 110 is positioned very near the fixing unit 94. When printing starts from this state when the next printing job arrives, not the next page 111, but a page area 2 to 3 pages later is positioned in the image forming unit 102, so the space between the next page 111 and this page area is not printed and becomes a blank page. This is a waste of paper.

As shown by the arrows in the figure, in order to do away with this blank page, after the last printed page 110 has been fixed by the fixing unit 94, it is proposed to feed the paper backward at the start of the next job to a position where the image forming unit 102 can transfer an image to the next page 111.

FIG. 34 is a drawing explaining the problems with the prior art. In the fixation step such as flash-light, the flash light is flashed on the un-fixed toner, and the toner is melted by the heat and fixed. When doing this, the moisture in the paper (continuous paper) 100 is evaporated, and this dries the paper and causes it to shrink. As shown in FIG. 34, in the aforementioned printing operation sequence, the last page 110 of the previous printing has shrunk considerably by fixation, and the first page 111 of the next printing has not shrunk at all.

When a paper shrinkage difference occurs between these adjacent pages, since originally the paper was continuous paper with the same width, the paper with the width is pulled by the paper with the narrow width, and wrinkling in the shape of a sine curve occurs in the vertical direction. In other words, wrinkling occurs at the top of the first page 111 of the next printing.

Printing is then performed on this wrinkled starting page 111, and when the toner image is transferred to the page by the image formation unit, not all of the page in the width direction of the paper comes in uniform contact with the photo-sensitive drum, so there is a problem in that there are areas where no toner is transferred.

Particularly, in the case of a high-speed printer (for example when printing at 8000 lines/min.), the speed at which the continuous paper is moving is fast and the transfer time is short. Therefore, there is a good chance that toner will not be transferred to the areas of no contact due to the wrinkling.

Moreover, in a double-side printing device, fixation energy is applied from both side of the paper by the fixation unit, so there is a large amount of moisture that evaporates from the paper. Therefore, there is a large amount of paper shrinkage, and it becomes easy for wrinkling to occur in the first page.

SUMMARY OF THE INVENTION

The objective of this invention is to provide a printing device and printing method for reducing the amount of wrinkling that occurs in the leading region of the record medium, and preventing poor toner transfer to this leading region.

Another objective of the invention is to provide a printing device and printing method, for reducing the amount of wrinkling that occurs in the leading region of the record medium and preventing poor toner transfer to this leading region, which is simply constructed.

A further objective of the invention is to provide a printing device and printing method for reducing the amount of wrinkling that occurs in the leading region of the record medium and preventing poor toner transfer to this leading region, in which it is possible to adjust the amount of moisture evaporation in the end region.

Still a further objective of the invention is to provide a printing device and printing method for reducing the amount of wrinkling that occurs in the leading region of the record medium and preventing poor toner transfer to this leading region, in which it is possible to adjust the amount of moisture evaporation in the leading region.

Yet another objective of the invention is to provide a printing device and printing method for selectively preventing poor toner transfer to the leading region of the record medium due to wrinkling of the leading region.

Even yet a further objective of the invention is to provide a printing device and printing method for automatically detecting the occurrence of wrinkling in the leading region of the record medium that may affect the transfer of toner, and for selectively preventing poor toner transfer to this leading region due to wrinkling.

In order to accomplish the objectives of the invention, the printing method of this invention comprises: an image formation step of transferring a toner image to a continuous record medium by an image formation unit; a fixation step of fixing the toner image on the record medium; a step of adjusting the amount of moisture of the record medium for reducing the difference in the amount of shrinkage between a final printing area of the record medium of a previous printing instruction and a next printing area after the final printing area; and a step of positioning the next printing area at the image formation unit after fixation of the final printing area of the previous printing instruction has been completed.

Moreover, the printing device of this invention comprises: an image formation unit for transferring a toner image to a continuous record medium; a fixation unit for fixing the toner image to the record medium; and adjusting means for adjusting the amount of moisture of the record medium for reducing the difference in the amount of shrinkage between the final printing area of the record medium of the previous printing instruction and the next printing area after the final printing area.

In this form of the invention, there is a step or means of adjusting the amount of moisture of the record medium for reducing the difference in the amount of shrinkage between the final printing area of the record medium of the previous printing instruction and the next printing area after the final printing area, so it is possible to reduce the difference in the amount of shrinkage between the final printing area and the next printing area, and thus it is possible to reduce the occurrence of wrinkling in the leading area of the next printing instruction. This makes it possible to prevent poor toner transfer to the leading area of the next printing instruction.

The printing device of another feature of this invention comprises: a feeding unit for feeding the continuous record medium; an image formation unit for transferring a toner image to the record medium; a fixation unit for fixing the toner image to the record medium; and a control unit for controlling the feeding unit in order to position the next printing area on the record medium following the final printed area after the final printing area on the record medium of the previous printing instruction has been fixed.

In one form of the invention, the control unit controls the fixation unit such that fixation energy of the fixation unit for the final printing area is less than the fixation energy for area other than the final printing area.

In this form of the invention, since the fixation energy at the final printing area is reduced, it is possible to reduce the amount of moisture evaporation at the final printing area. Therefore, it is possible to reduce the amount of shrinkage of the final printing area, and lessen the amount of wrinkling of the leading area for the next printing instruction. This makes it possible to prevent poor toner transfer at the leading area for the next printing instruction.

In the printing device of another form of the invention, the control unit further controls the fixation unit such that it applies fixation energy to the final printing area at the start of the next printing instruction. In this form of the invention, since the fixation energy at the final printing area has been lowered, fixation occurs, but is not complete fixation. Therefore, fixation energy is applied to the final printing area at the start of the next printing instruction to complete fixation. In this case, fixation is performed at the start of the next printing instruction, and toner is transferred to the leading printing area. Therefore, poor toner transfer to the leading printing area does not occur, even when fixation energy is applied to the final printing area.

In the printing device of another form of the invention, the control unit controls the feeding unit so that after fixation energy is applied by the fixation unit to the next printing area following the final printing area, the next printing area is positioned at the image formation unit.

In this form of the invention, since fixation energy is applied to the next printing area in advance, a certain amount of moisture is evaporated from the unprinted next printing area. Therefore, the next printing area shrinks a little, and the difference in shrinkage with that of the final of printing area becomes small, and the occurrence of wrinkling of the leading area for the next printing instruction is reduced. This makes it possible to prevent poor toner transfer to the leading area for the next printing instruction.

The printing device of another form of the invention comprises a moisture adjustment means for reducing the amount of moisture in the record medium of the next printing area. In this form of the invention, since the amount of moisture of the next printing area is reduced, the next printing area is shrunk a certain extent. Therefore, the difference in shrinkage with that of the final printing area becomes small, and the occurrence of wrinkling of the leading area for the next printing instruction is reduced. This makes it possible to prevent poor toner transfer to the leading area for the next printing instruction.

In the printing device of another form of the invention, by further having a selection-control unit for selectively operating the moisture-adjustment means, the wrinkle smoothing operation is not executed when there is no effect on toner transfer to the next page, so it is possible to keep any drop in the printing speed to a minimum.

Moreover, in the printing device of another form of the invention, the selection-control unit comprises a selection-control unit for detecting the printing dot distribution of the final printing area, and selectively operating the moisture-adjustment means, so it is possible to easily detect occurrence of wrinkling on the next page and whether there will be any effect on toner transfer.

Furthermore, in the printing device of yet another form of the invention, the selection-control means calculates the printing rate for each division of the final printing area that has been divided from the printing data of the final printing area, calculates the wrinkling value from the coefficients of the aforementioned printing rate, sub-scanning direction and main scanning direction, and determines where to selectively operated the moisture-adjustment means, thus it is possible to accurately detect the occurrence of wrinkling of the next page.

BRIEF DESCRIPTION OF THE DRAWINGS

FIG. 14 is a drawing showing the relationship between the FV voltage and fixation rate for this invention.

DESCRIPTION OF THE PREFERRED EMBODIMENTS

The preferred embodiments of the present invention will be explained in the order of printing device, printing process and other embodiments.

[Printing Device]

Figure 1:
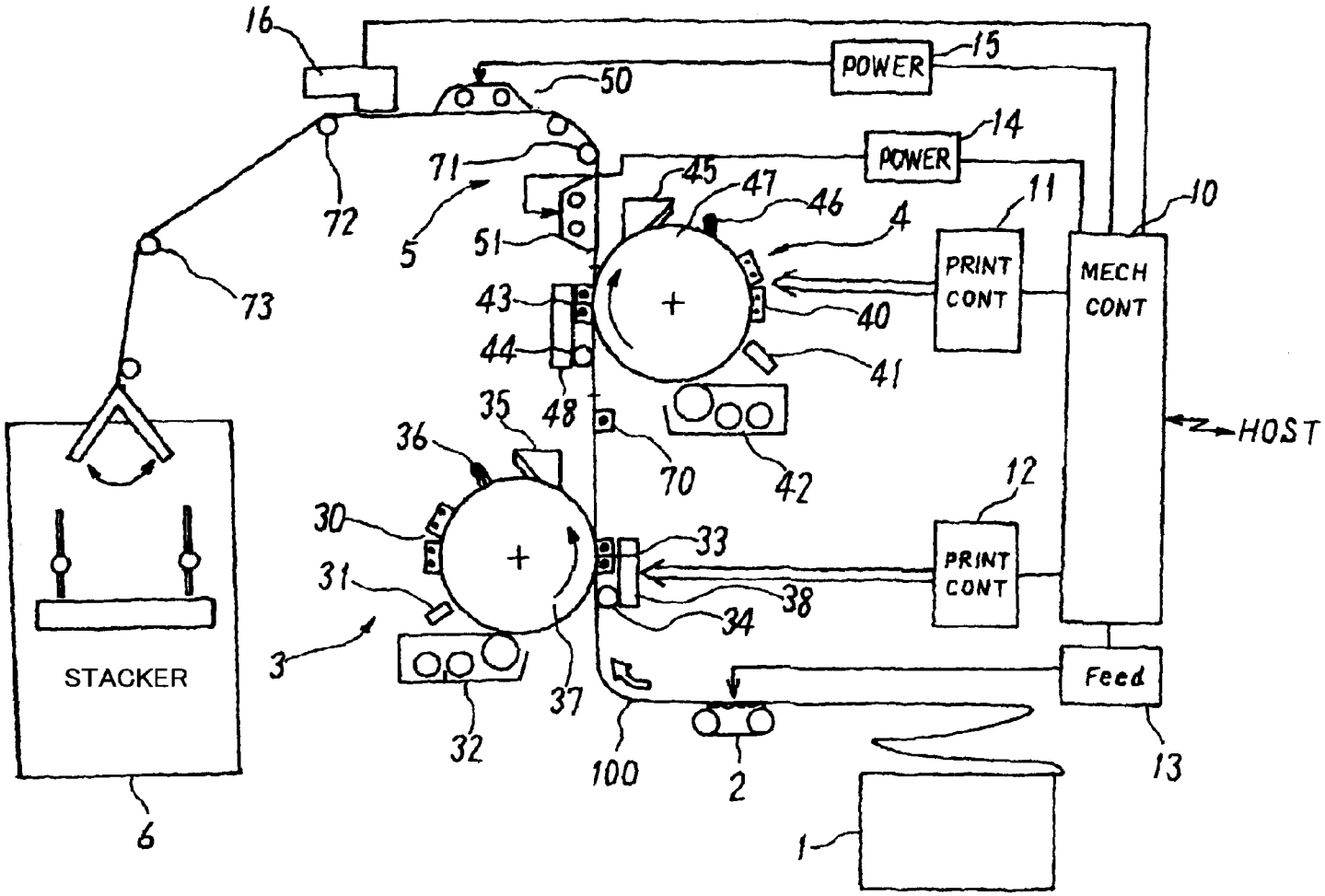
FIG. 1 is a schematic drawing of the printing device of an embodiment of the invention.
Figure 2:
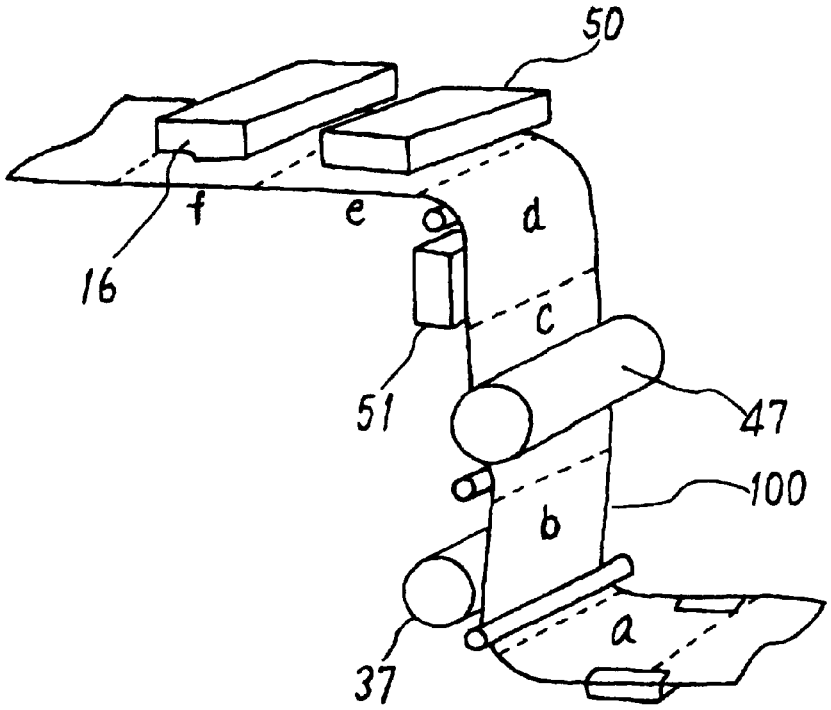
FIG. 2 is a pictorial drawing of the printing device in FIG. 1.
Figure 3:
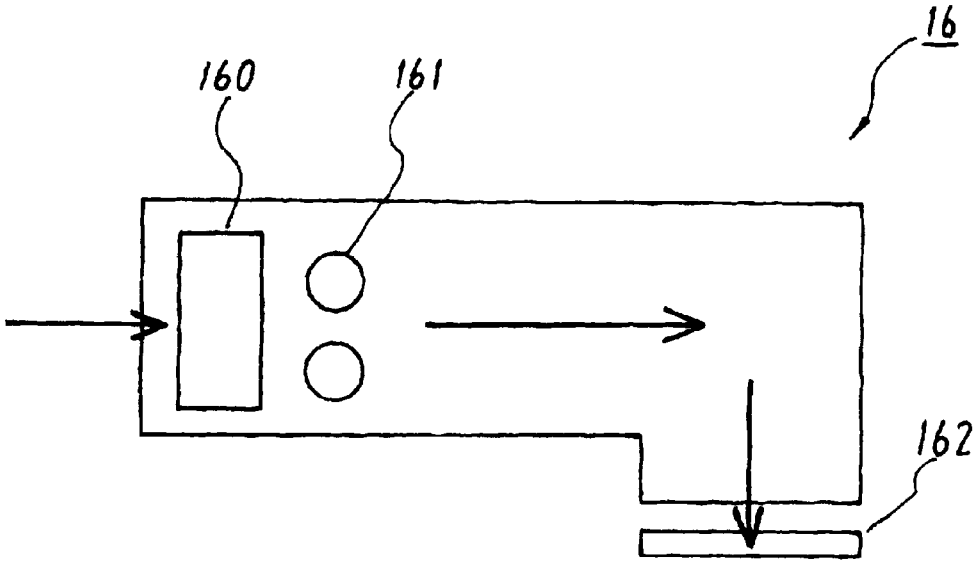
FIG. 3 is a schematic drawing of the moisture adjustment mechanism in FIG. 1.
Figure 4:
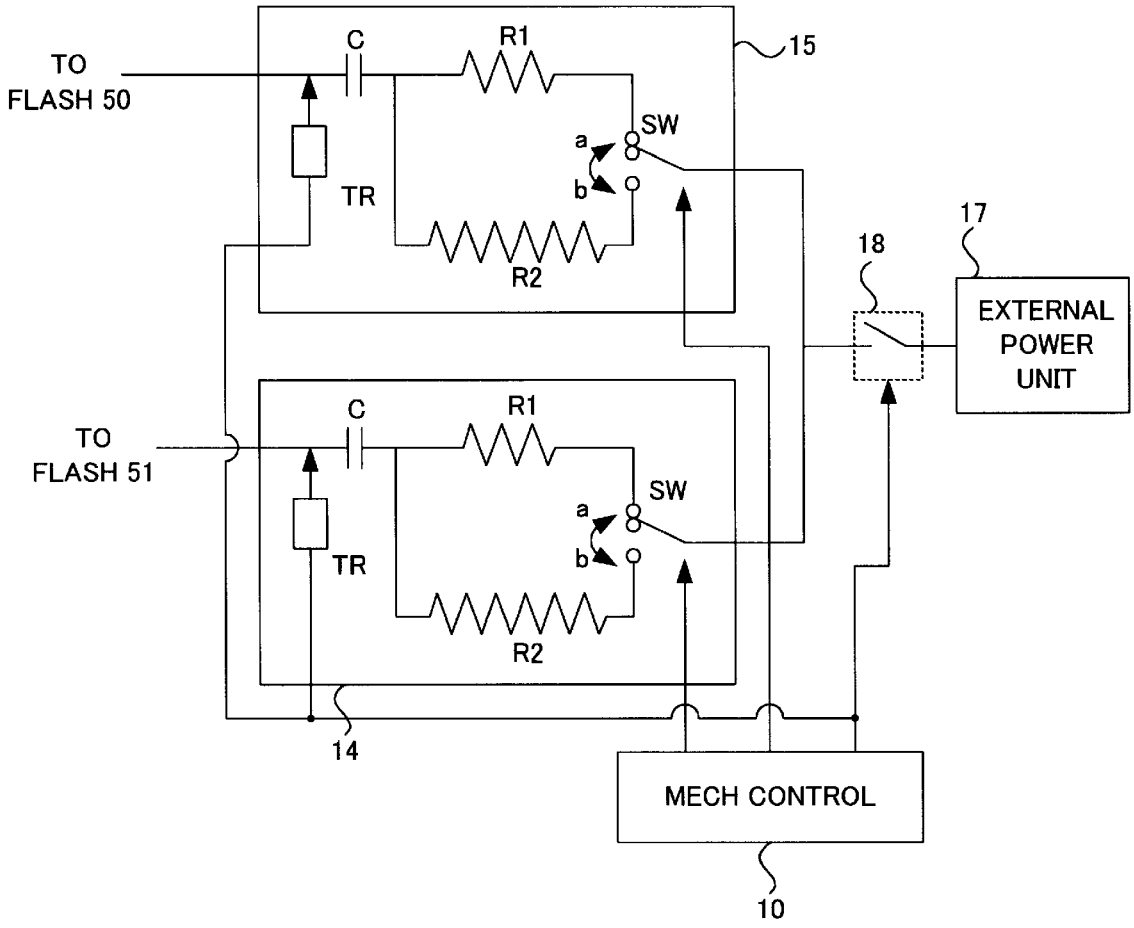
FIG. 4 is a schematic drawing of the flash power-supply unit in FIG. 1.

FIG. 1 is a schematic drawing of the printing device of an embodiment of the invention. FIG. 2 is a pictorial drawing of the main parts of FIG. 1. FIG. 3 is a schematic drawing of the moisture adjustment mechanism in FIG. 1, and FIG. 4 is a schematic drawing of the flash power-supply circuit in FIG. 1.

FIG. 1 shows a double-side printing device that prints on both sides of continuous paper that has feeding holes. A hopper 1 stores the unprinted continuous paper 100. The continuous paper 100 has machine perforations on each page. A paper-feed tractor 2 meshes with the feeding-holes in the continuous paper 100, and feeds the continuous paper 100 in the direction of the arrow. A backside printing mechanism (second image formation unit) 3 comprises an electronic photographic printing mechanism, and prints the backside of the continuous paper 100.

This backside printing mechanism 3 comprises a photo-sensitive drum 37, a charging device 30 for charging the photo-sensitive drum 37, and an LED head 31 for exposing a single-line optical image on the photo-sensitive drum 37. This LED head 31 comprises an array of a plurality of LEDs (light-emitting diodes) that are arrayed in one line.

A developer 32 develops the image on the photo-sensitive drum 37 by toners. A transfer charger 33 transfers the image developed on the photo-sensitive drum 37 to the backside of the continuous paper 100. A transfer-guide roller 34 pushes the continuous paper 100 against the photo-sensitive drum 37 during the transfer. A retractor mechanism 38 retracts the transfer-guide roller 34 when not performing transfer to prevent the photo-sensitive drum 37 from coming in contact with the continuous paper 100. A cleaner 35 recovers the residual toners from the photo-sensitive drum 37. A discharge lamp 36 discharges the residual potential on the photo-sensitive drum 37.

A front side printing mechanism (first image formation unit) 4 also comprises an electronic photographic printing mechanism. The front side printing mechanism 4 that prints the front surface of the continuous paper 11 is located downward from the backside printing mechanism 3 in the direction of flow of the paper.

This front side printing mechanism 4 comprises a photo-sensitive drum 47, a charging device 40 for charging the photo-sensitive drum 47, and an LED head 41 for exposing a single-line optical image on the photo-sensitive drum 47. This LED head 41 comprises an array of a plurality of LEDs (light-emitting diodes) that are arrayed in one line.

A developer 42 develops the image on the photo-sensitive drum 47 by toners. A transfer charger 43 transfers the image developed on the photo-sensitive drum 47 to the front side of the continuous paper 100. A transfer-guide roller 44 pushes the continuous paper 100 against the photo-sensitive drum 47 during the transfer. A retractor mechanism 48 retracts the transfer-guide roller 34 when not performing transfer to prevent the photo-sensitive drum 47 from coming in contact with the continuous paper 100. A cleaner 45 recovers the residual toner from the photo-sensitive drum 47. A discharge lamp 46 discharges the residual potential on the photo-sensitive drum 47.

A neutralizing charger 70 is located between the backside printing mechanism 3 and the front side printing mechanism 4, and neutralizes the potential on the front side of the continuous paper 100 that was charged by the backside printing mechanism 3. This makes it possible for the transfer operation by the front side printing mechanism 4 to be performed stably.

A guide roller 71 changes the direction of the vertically fed continuous paper 100 to a horizontal direction. A fixation unit 5 comprises a pair of flash fixation units 50, 51. The flash fixation unit 50 fixes the toner image on the front side of the continuous paper 100 with a flash of light, and the flash fixation unit 51 fixes the toner image on the backside of the continuous paper 100 with a flash of light. A stacker 6 stacks the printed continuous paper 100. Scuff rollers 72, 73 direct the continuous paper 100 with the fixed image to the stacker 6.

A moisture adjustment mechanism 16 is located downward from the flash fixation unit 50, and it adjusts the amount of moisture in the continuous paper 100. It will be described later with the use of FIG. 3. A mechanism control unit 10 controls the mechanisms of the printing device according to printing instructions and printing data from the host computer. A first printing controller 11 controls the front side printing mechanism according to instructions from the mechanism control unit 10. A second printing controller 12 controls the backside printing mechanism 3 according to instructions from the mechanism control unit 10. A paper-feed control unit 13 controls the amount of feed by the feed tractor 2 according to instructions from the mechanism control unit 10.

A first flash power-supply unit 15 is controlled by the mechanism control unit 10, and it controls the flash emission of the first flash fixation unit 50. A second flash power-supply unit 14 is controlled by the mechanism control unit 10, and it controls the flash emission of the second flash fixation unit 51. This will be described later using FIG. 4.

When printing two sides of the paper with this double-side printing device, the backside printing mechanism 3 starts printing before the front side printing mechanism 4. Also, the paper feed path is in the vertical direction, and this feed path is located between the backside printing mechanism 3 and front side printing mechanism 4. Therefore, it is possible to make the double-side printing device compact.

Next, the retractor mechanisms 38, 48 will be explained. There are transfer chargers 33, 34 and transfer-guide rollers 34, 44 on a transfer frame. The transfer frame is driven by a drive source (stepping motor). When the transfer frame is at the transfer position, the transfer-guide roller 34 is located in a position where it pushes the paper against the photo-sensitive drum 37, and the transfer charger 33 comes very close to the photo-sensitive 37.

When the transfer frame is moved back to the retracted position by the drive source, the transfer-guide roller 34 is separated from the photo-sensitive drum 37, as well as is the transfer charger 33. At this retracted position, the paper is not pushed against the photo-sensitive drum 37 and it is a position with no contact with the photo-sensitive drum 37. The retractor mechanism 48 of the front side printing mechanism 4 is the same. Therefore, an explanation of the retractor mechanism 48 is omitted.

The double-side printing operation is explained below. As shown in FIG. 1, when performing double-side printing, the transfer roller 34 in the backside printing mechanism 3 presses the continuous paper 100 against the photo-sensitive drum 37 by the retractor mechanism 38, and the transfer roller 44 in the front side printing mechanism 4 presses the continuous paper against the photo-sensitive drum 47 by the retractor mechanism 48.

As shown in FIG. 2, both printing mechanisms 3, 4 operate and a toner image is formed on both sides of the continuous paper 100. Also, the continuous paper 100 is fed top the fixation unit 5 and the toner image is fixed to the continuous paper 100.

It is also possible to perform single-side printing. When performing single-side printing, the front side printing mechanism 4 is used. In the backside printing mechanism 3, the transfer roller 34 moves the continuous paper 100 away from the photo-sensitive drum 37 by the retractor mechanism 38. In the front side printing mechanism 4, the transfer roller 44 presses the continuous paper 100 against the photo-sensitive drum 47 by the retractor mechanism 48.

Moreover, only the front side printing mechanism 4 operates, and a toner image is formed only on the front side of the continuous paper 100. The toner image on the continuous paper 100 is then fixed by the fixation unit 50. In this single-side printing operation, the front side printing mechanism 4 is closer to the fixation unit 5 than the backside printing mechanism 3 so it is possible to shorten the distance between the fixation unit 5 and the functioning printing mechanism 4. Therefore, it is possible to keep the wasted blank space between the fixation unit 5 and the printing mechanism 4 to a minimum. Furthermore, when the continuous paper 100 is fed backward to the front side printing mechanism 4 at the start of single-side printing, then it is possible to reduce the amount of back-feed. Therefore, it is possible to reduce the time required for performing back-feed at the start of single-side printing.

Also, during single-side printing, the backside printing mechanism 3 is stopped. This makes it possible to prevent unnecessary operation of the backside printing mechanism 3. Moreover, since the transfer roller 34 of the backside printing mechanism 3 is retracted to the retracted position, it is possible to prevent the photo-sensitive drum 37 of the backside printing mechanism 3 from coming in contact with the continuous paper 100, and that makes it possible to prevent the continuous paper 100 from becoming dirty during single-side printing.

Next, the moisture adjustment mechanism 16 will be explained using FIG. 3. The moisture adjustment mechanism 16 comprises a fan 160, a halogen lamp 161 and a shutter 162. Air is fed from the fan 160 to the halogen lamp 161 to generate hot-air flow. When the shutter 162 opens, this hot air comes in contact with the continuous paper 100. The fan 160, the halogen lamp 161 and the shutter 162 are controlled by the mechanism control unit 10. This moisture adjustment mechanism 16 is used for reducing the moisture content of the next page (leading page of the next job) that follows the final page of the previous job.

The flash power-supply units 14, 15 will be explained using FIG. 4. The flash power-supply units 14, 15 are connected to the external power supply 17 by way of a switch 18. By the flash starting command from the mechanism control unit 10, the switch 18 is turned ON and power is supplied from the external power supply 17 to the power-supply units 14, 15.

Each of the flash power-supply units 14, 15 comprises a switch SW, a first resistor R1, a second resistor R2, capacitor C and trigger circuit TR. When the switch SW is set to the 'a' side, the capacitor C is charged by way of the resistor R1. When the resistance of the resistor R1 is set to be smaller than that of the resistor R2, then the current flowing to the capacitor C becomes large, and the charge potential of the capacitor C becomes high. The trigger circuit TR applies the potential from the capacitor C to the flash lamp of the flash fixation unit 50 for a specified period when the flash lamp is started as described above. In doing so, high voltage is applied to the flash lamp. This is the Hi flash mode.

On the other hand, when the switch SW is switched to the 'b' side, the capacitor C is charged by way of the second resistor R2. The resistance of the resistor R2 is larger than that of the resistor R1, so the current flowing to the capacitor C becomes small, and the charge potential of the capacitor C becomes low. The trigger circuit TR applies the potential from the capacitor C to the flash lamp of the flash fixation unit 50 for a specified period when the flash lamp is started as described above. In doing so, low voltage is applied to the flash lamp. This is the Lo flash mode.

The mechanism control unit 10 controls switching of the switch SW according to the mode. The operation for the power-supply unit 15 is the same.

[Printing Process]

Figure 5:
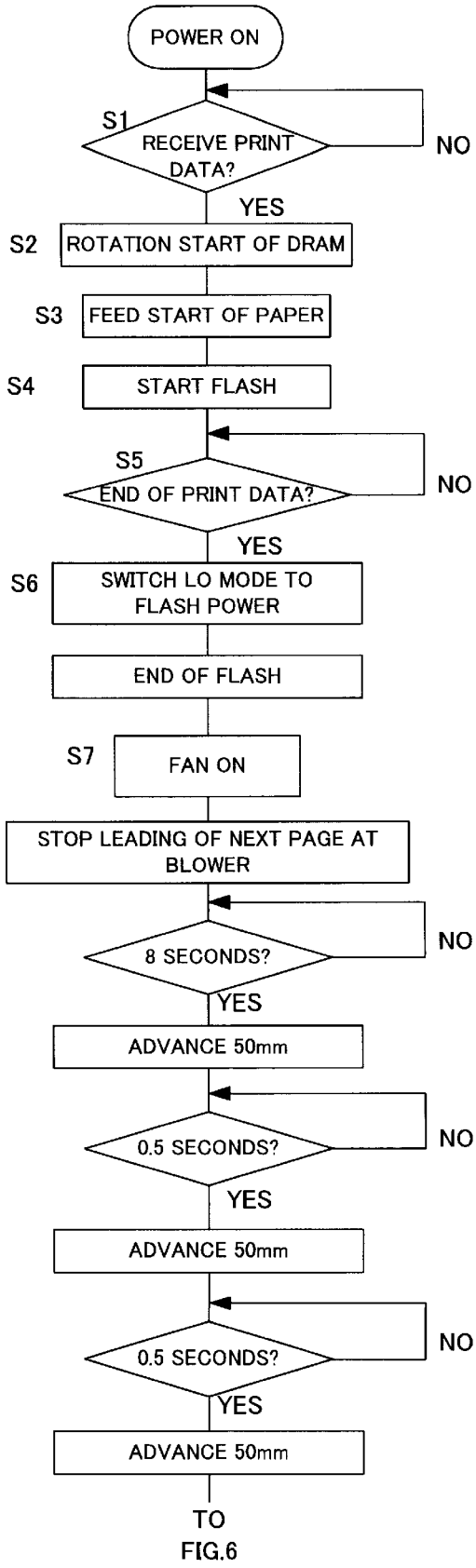
FIG. 5 is a flowchart (1/2) showing the printing process of an embodiment of this invention.
Figure 6:
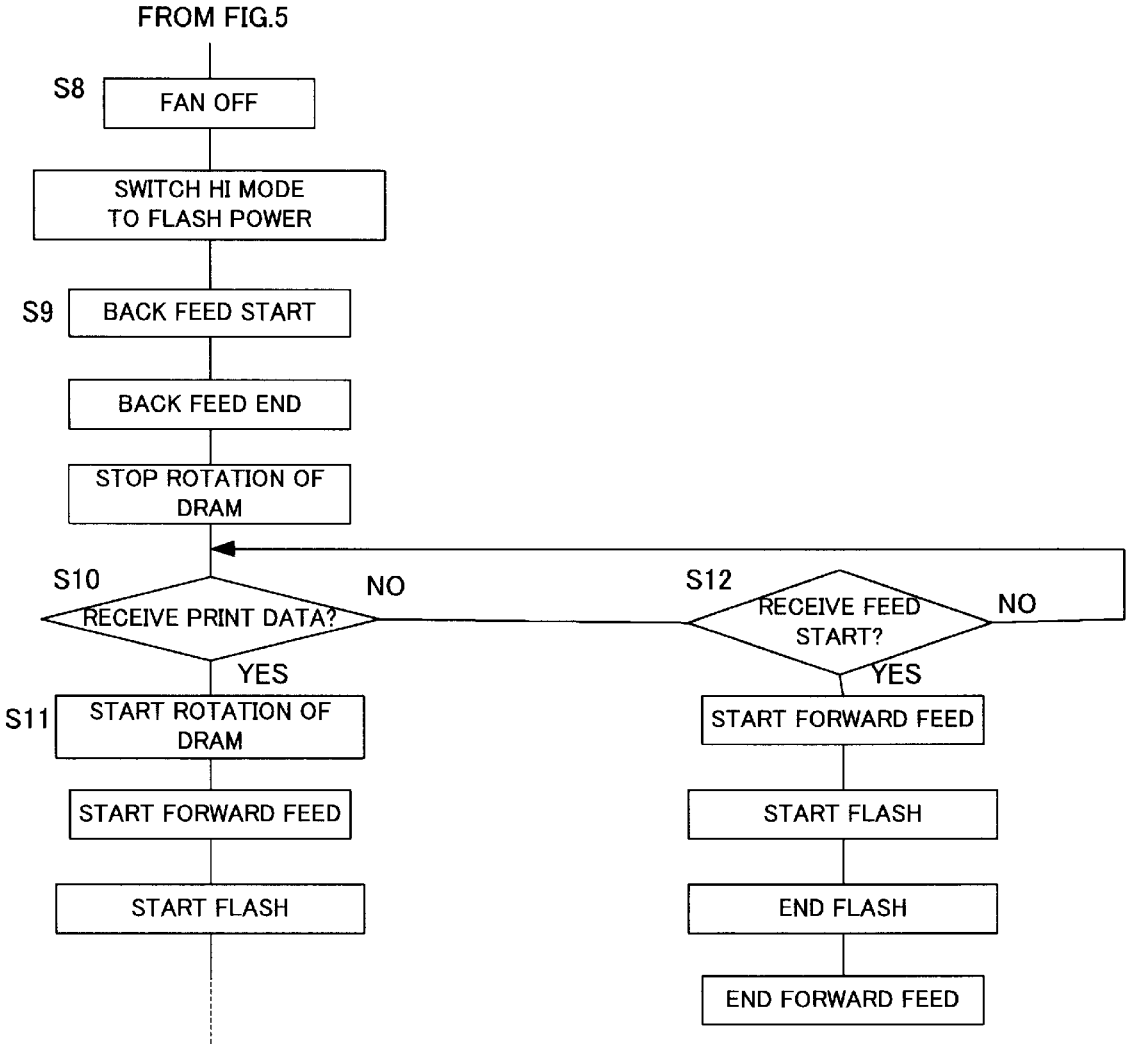
FIG. 6 is a flowchart (2/2) showing the printing process of an embodiment of the invention.
Figure 7:
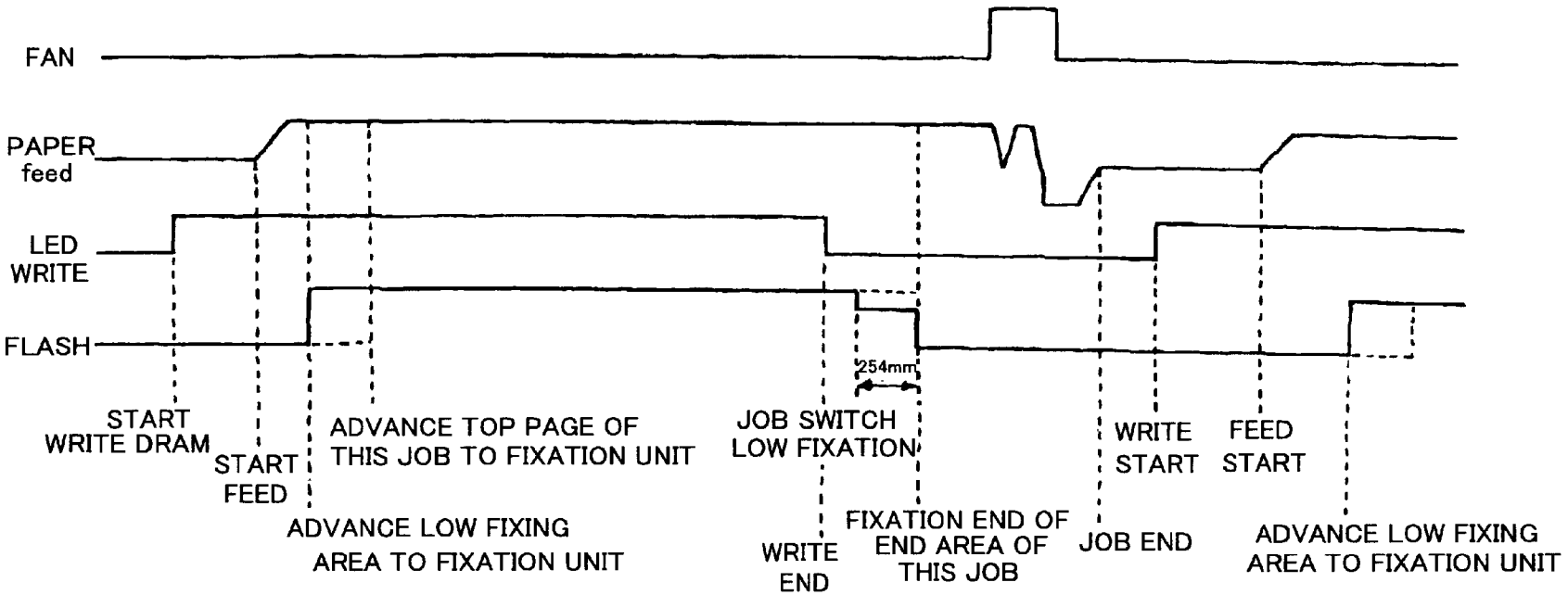
FIG. 7 is a sequence drawing of the printing process of an embodiment of the invention.
Figure 10:
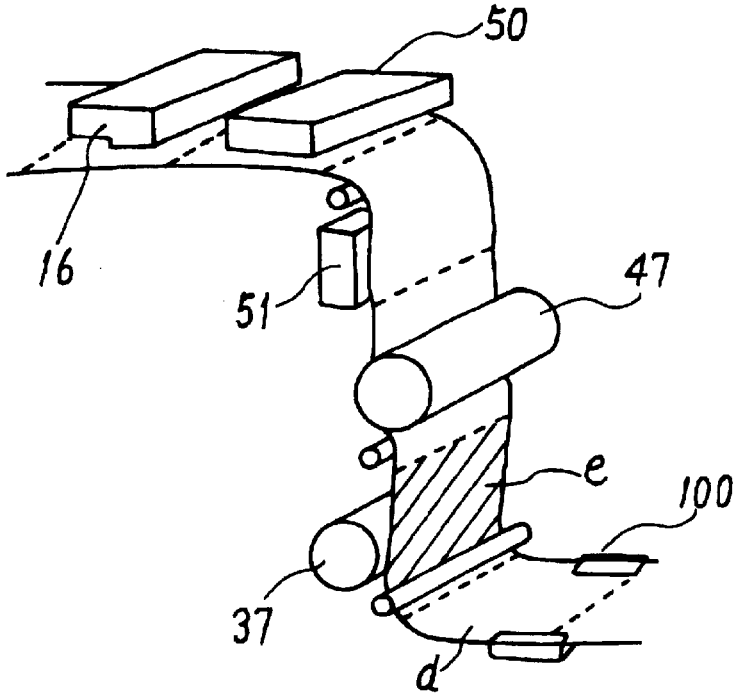
FIG. 10 is a drawing explaining the back feed operation.
Figure 11:
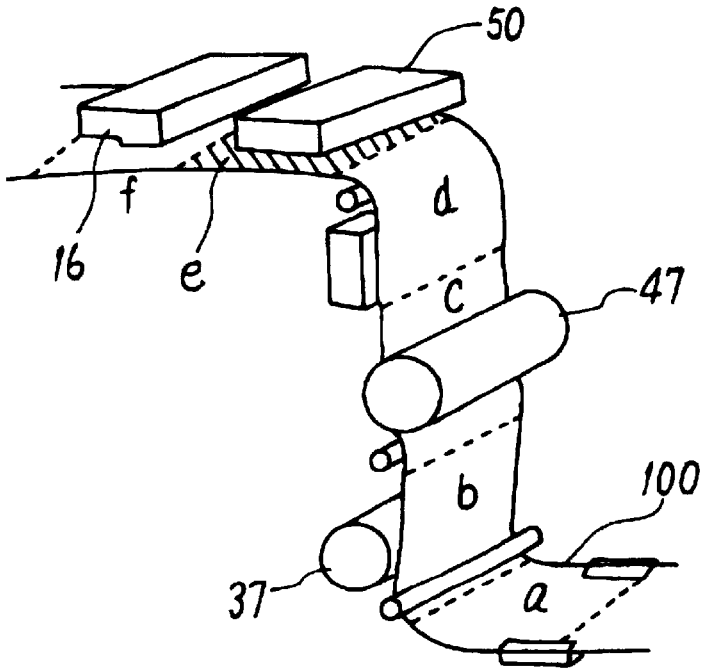
FIG. 11 is a drawing explaining the re-fixation operation for the final page.
Figure 12:
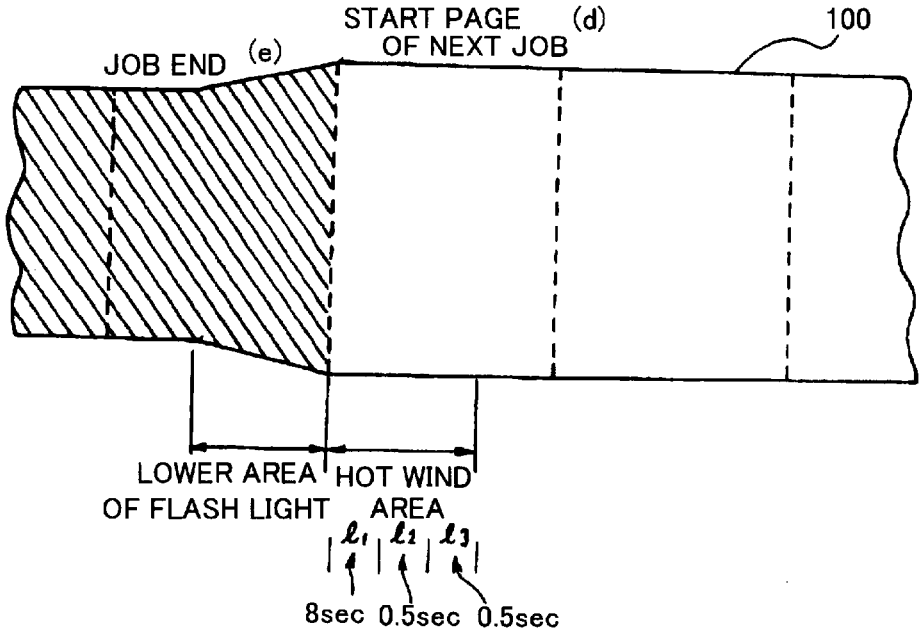
FIG. 12 is a drawing explaining the shrinkage of the continuous paper by this invention.

FIG. 5 and FIG. 6 are flowcharts of the printing process of the mechanism control unit in FIG. 1. FIG. 7 is a sequence drawing of that operation. FIG. 8 thru FIG. 11 are drawings explaining the printing operation, and FIG. 12 is a drawing explaining the state of the continuous paper.

The printing process will be explained starting from FIG. 5.

(S1) After the power has been turned ON, the printing device waits for printing data (job start instruction) from the host.

(S2) When the device receives an instruction from the host to start a job, the mechanism control unit 10 operates the front side printing mechanism 4 and backside printing mechanism 3 by way of both the printing control units 11 and 12. By doing this, the photo-sensitive drums 37, 47 begin to rotate and toner images are formed on the photo-sensitive drums 37, 47 according to the printing data (LED write start in FIG. 7).

(S3) Next, the mechanism control unit 10 starts to move the continuous paper 100 forward to the tractor 2 by way of the feed-control unit 13. By this, the continuous paper 100 is fed forward (in the direction of the arrow in FIG. 1). When this happens the paper begins to be pressed into contact with the photo-sensitive drums 37, 47 by transfer guides of the retractor mechanisms 38, 48. The toner images are then formed on both sides of the continuous paper 100.

(S4) The mechanism control unit 10 starts the flash lamp. By doing this, the power-supply units 14, 15 are connected to the external power supply 17, and through the aforementioned charge and trigger discharge, the flash lamps of the flash fixation units 50, 51 generate a flash of light at a set interval. In this case, in the initial state, the switches SW of the power-supply units 14, 15 are set to side 'a' (Hi flash mode). Also, the fixation voltage FV to the flash lamp becomes high (for example, 1850 V) and the flash fixation energy is high. In this state, the toner image is fixed to the continuous paper (S5) When the mechanism control unit 10 receives a job end (printing end) instruction from the host, it ends LED writing to the photo-sensitive drums 37, 47 (see FIG. 7).

Figure 8:
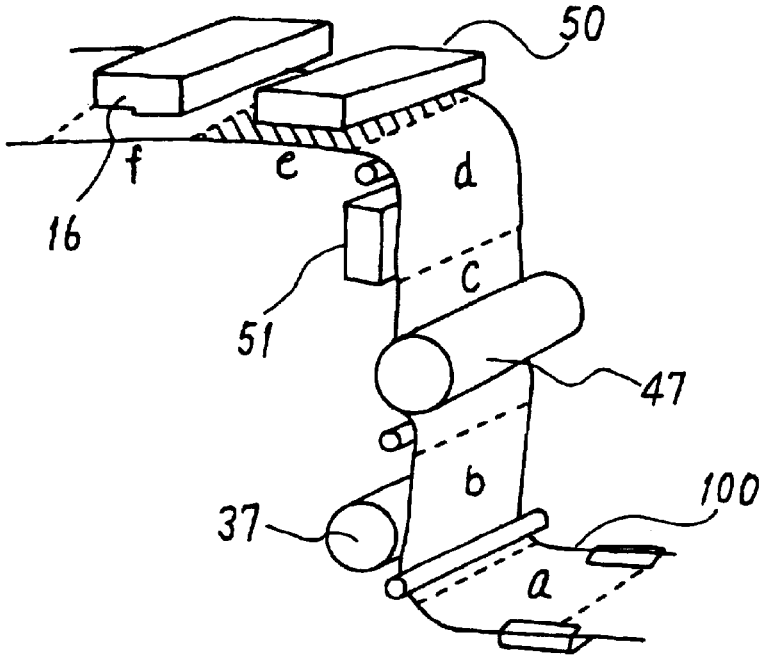
FIG. 8 is a drawing explaining the fixation operation for the final page.

(S6) Next, the mechanism control unit 10 switches the switch SW on the power-supply units 14, 15 to side 'b' (Lo flash mode). Also, the fixation voltage FV supplied to the flash lamp becomes low (for example, 1500 V), and the flash fixation energy is low. As shown in FIG. 7 and FIG. 8, the final printing page 'e' of the job is fixed with low fixation energy. Also the mechanism control unit 10 turns OFF the flash lamp. In other words, it turns OFF the switch 18. This stops the flash-light.

Figure 9:
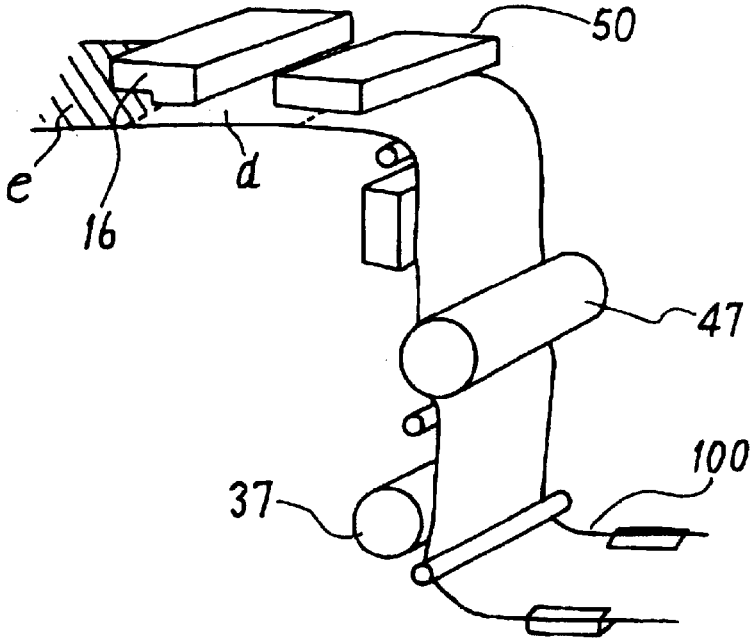
FIG. 9 is a drawing explaining the moisture adjustment operation for the leading page.

(S7) The mechanism control unit 10 then turns ON the moisture-adjustment mechanism (fan) 16. In other words, it opens the shutter 162 shown in FIG. 3. At this time, the fan 160 and halogen lamp 161 are turned ON together with power ON. The hot air from the moisture-adjustment mechanism 16 is blown on the continuous paper 100. At this time, as shown in FIG. 9, the continuous paper 100 is stopped so, the hot air is blown on the next page 'd' after the final page 'e'.

As the method of blowing this hot air, first, the leading portion of the next page is stopped at the hot-air outlet of the shutter 162 (range of 50 mm), and it is blown by the hot air for 8 seconds. Next, the paper is moved forward 50 mm, and the hot air is blown for 0.5 seconds. The paper is moved forward another 50 mm and the hot air is blown for another 0.5 seconds. The paper is then moved another 50 mm and stops. In this way, the amount of moisture in the leading area L1 of the next page 'd' is reduced, and it is possible to adjust the moisture content of the leading page 'd' of the continuous paper 100 such that it is nearly the same as the moisture content of the final page 'e'.

(S8) Next, moving to FIG. 6, the moisture-adjustment mechanism (fan) 16 is turned OFF. In other words, the shutter 162 shown in FIG. 3 is closed. Furthermore, the switches SW of the power-supply units 14, 15 are returned to side 'a' (Hi flash mode).

(S9) The mechanism control unit 10 starts moving the continuous paper 100 backward to the tractor 2 by way of the feed control unit 13. Also, as shown in FIG. 10, the continuous paper 100 stops when the photo-sensitive drum 37 of the backside printing unit 3 is in a position where it is capable to perform transfer to the next page (leading page of the next job) 'd' after the final page 'e'. In the next job, printing is possible from the next page 'd' after then final page 'e'. Both image formation units 3, 4 then stop. By this, the job ends and the mechanism control unit 10 becomes in the wait state for the next job.

(S10) The mechanism control unit 10 waits for a command from the host.

(S11) When the mechanism control unit 10 receives a start command for the next job, it rotates the both image formation units 3, 4 and start moving the paper forward, the same as in step S2. Furthermore, it starts the flash lamp. Here, as was explained in step S4 above, the timing for starting the flash lamp, is the timing of when the final page 'e' of the previous printing job advanced to the fixation unit 50 as shown in FIG. 7 and FIG. 11. The final page 'e' is fixed again. The reason for this is that the fixation energy for the final page 'e' in step S6 above was low. The fixation energy was lowered enough to where it only melts and fixes the toner. Therefore, when left as is, the image could be blurred when rubbed. To prevent this, the final page 'e' is re-fixed at the start of the next job. After this, the same steps as from step S5 are executed.

(S12) On the other hand, when the mechanism control unit 10 receives a paper output command from the host, it starts to move the paper forward, and also starts the flash lamp. By doing this, the final page 'e' is re-fixed the same as was done in step S11. It then ends the flash lamp and finishes moving the paper forward.

As shown in FIG. 12, for the area of the leading page side of the next job which follows the final page 'e', of the current job, the amount of flashed light is reduced, and the image is fixed. Therefore, the shrinkage in this area is reduced. Since the difference in the amount of shrinkage with that of the leading page 'd', on which no toner image is formed, becomes small, so it is possible to prevent the occurrence of wrinkling of the leading page 'd'. This area is regulated by the fixation width of the flash fixation unit 50.

Moreover, the moisture content of the paper is reduced by blowing the leading area of the leading page 'd' with the hot air from the moisture-adjustment mechanism 16. Therefore, the leading area also shrinks a little, and this makes the difference in the amount of shrinkage with that of the leading page 'd', on which no toner image is formed, become small, so it is possible to prevent the occurrence of wrinkling of the leading page 'd'.

Furthermore, the amount of moisture of the leading area of the leading page 'd' is adjusted to be as low as the leading page. Therefore, the amount of shrinkage from the final page 'e' to the leading page 'd' becomes continuous, and this makes it even more possible to prevent the occurrence of wrinkling of the leading page.

In addition, since the final page 'e', for which the amount of flashed light was reduced, is re-fixed when the next job starts, the fixation rate is not affected, even though the amount of flash for the final page 'e' is reduced.

This function for adjusting the moisture content of the paper is applied to both the final page and the leading page, however, it can be applied to just the final page. Similarly, it can be applied to just the leading page. Also, to simplify the explanation, only the operation of the flash fixation unit 50 for the front side of the paper is explained, however the operation of the flash fixation unit 51 for the backside of the paper is the same, and energy is controlled for the final page 'e'. Of course it is possible to control the energy by just one of the fixation units.

Figure 13:
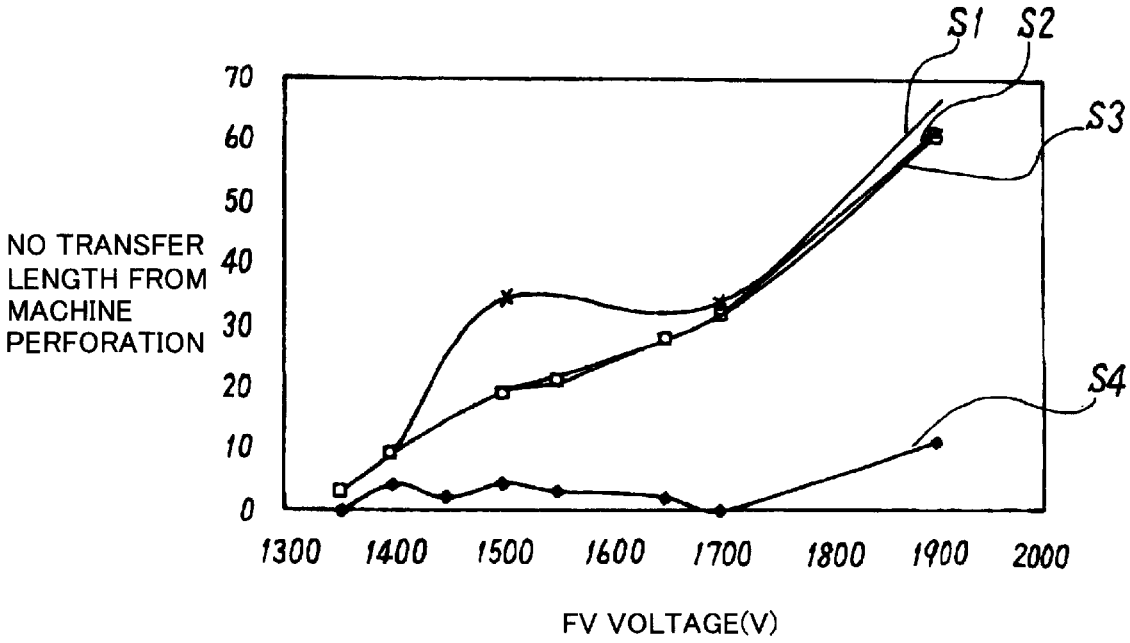
FIG. 13 is a drawing showing the relationship between the FV voltage and improper toner transfer for this invention.

Next, using FIG. 13 and FIG. 14, an effective flash voltage FV will be considered. FIG. 13 shows the relationship between the length from the machine perforation where there is no transfer and the flash voltage FV of the flash fixation unit. In other words, it shows the relationship between the flash voltage FV (flash fixation energy) for the final page 'e', and the length from the machine perforation of the leading page 'd' where there is no transfer.

S1 in FIG. 13 is for a complete black print length of 10 mm, S2 is for a complete black print length of 30 mm, S3 is for a complete black print length of 50 mm and S4 is for a complete black print length of 100 mm. From this figure it can be seen that the length with no transfer become shorter as the flash voltage FV becomes lower. The normal flash voltage FV is 1850 V.

On the other hand, FIG. 14 shows the relationship between the fixation rate that corresponds to the flash voltage FV, and print distortion. In other words, it shows the relationship between the fixation rate for thick paper (135 kg) and thin paper (55 kg), and print distortion at the scuff rollers 72,73, return roller 71, and follower roller (tractor position). Note that the print distortion is determined visually.

From this relationship, it is found that the fixation rate is high and that distorted printing is less the higher the flash voltage FV is. In other words, distorted printing occurs for a flash voltage FV of 1450 V or less. The relationships shown in FIG. 13 and FIG. 14 show that a flash voltage FV of 1550 V in the Lo flash mode is appropriate. This makes it possible to prevent distorted printing, as well as prevent the occurrence of wrinkling of the paper.

Figure 15:
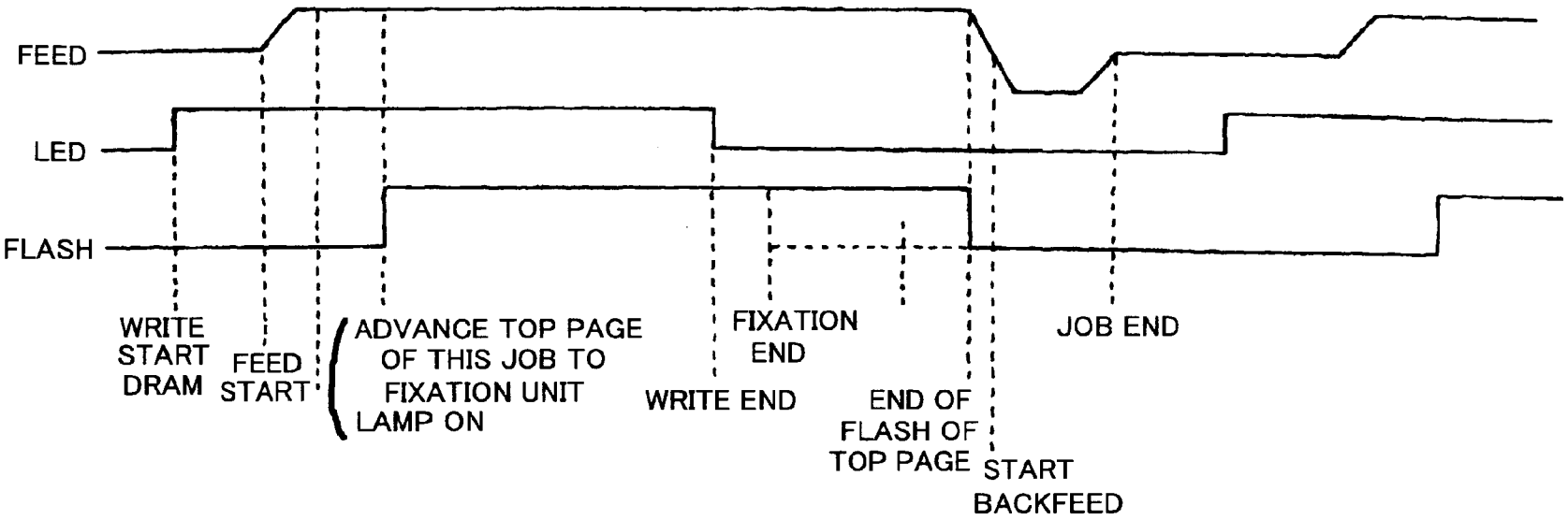
FIG. 15 is a sequence drawing of the printing process of another embodiment of the invention.

FIG. 15 is a sequence drawing of the operation of another embodiment of the invention. In this embodiment, the next page 'd', following the final page 'e', (starting page of the next job) is also irradiated with the flash light, and the moisture content of the leading page 'd' is also reduced. This embodiment provides a method of replacing the moisture-adjustment mechanism shown in FIG. 1.

In other words, as shown in FIG. 15, the continuous paper 100 is fed forward and the flash fixation unit continues to be ON even though LED writing ends and fixation of the final page 'e' of the current job is finished. In this way, the flash light is flashed onto the leading page 'd', the moisture content of the leading page 'd' is reduced and wrinkling is prevented.

In this embodiment as well, adjustment of the moisture content of the final page can be applied independently, or can be applied jointly.

[Other Embodiments]

As described above, when the printing rate for the last page is high and the paper is left for a short while when printing stops, wrinkling occurs in the paper due to the shrinkage of the fixed paper as the melted toner hardens, and as the moisture in the paper evaporates due to the melting heat of the toner, and this also affects the wrinkling of the next unfixed paper. Therefore, when the next printing starts, the toner will not be transferred to some areas due to effects of the wrinkling. The poor transfer is affected by the printing rate of the last page and the printing pattern.

Also, when the continuous jobs are executed with the aforementioned operation for preventing the occurrence of wrinkling, the printing speed drops. Therefore, by performing the operation for preventing the occurrence of wrinkling only in the case of wrinkling of paper with poor toner transfer, it is possible to prevent both poor toner transfer and the drop in printing speed. An embodiment for selectively performing this kind of operation to prevent the occurrence of wrinkling is explained.

Figure 16:
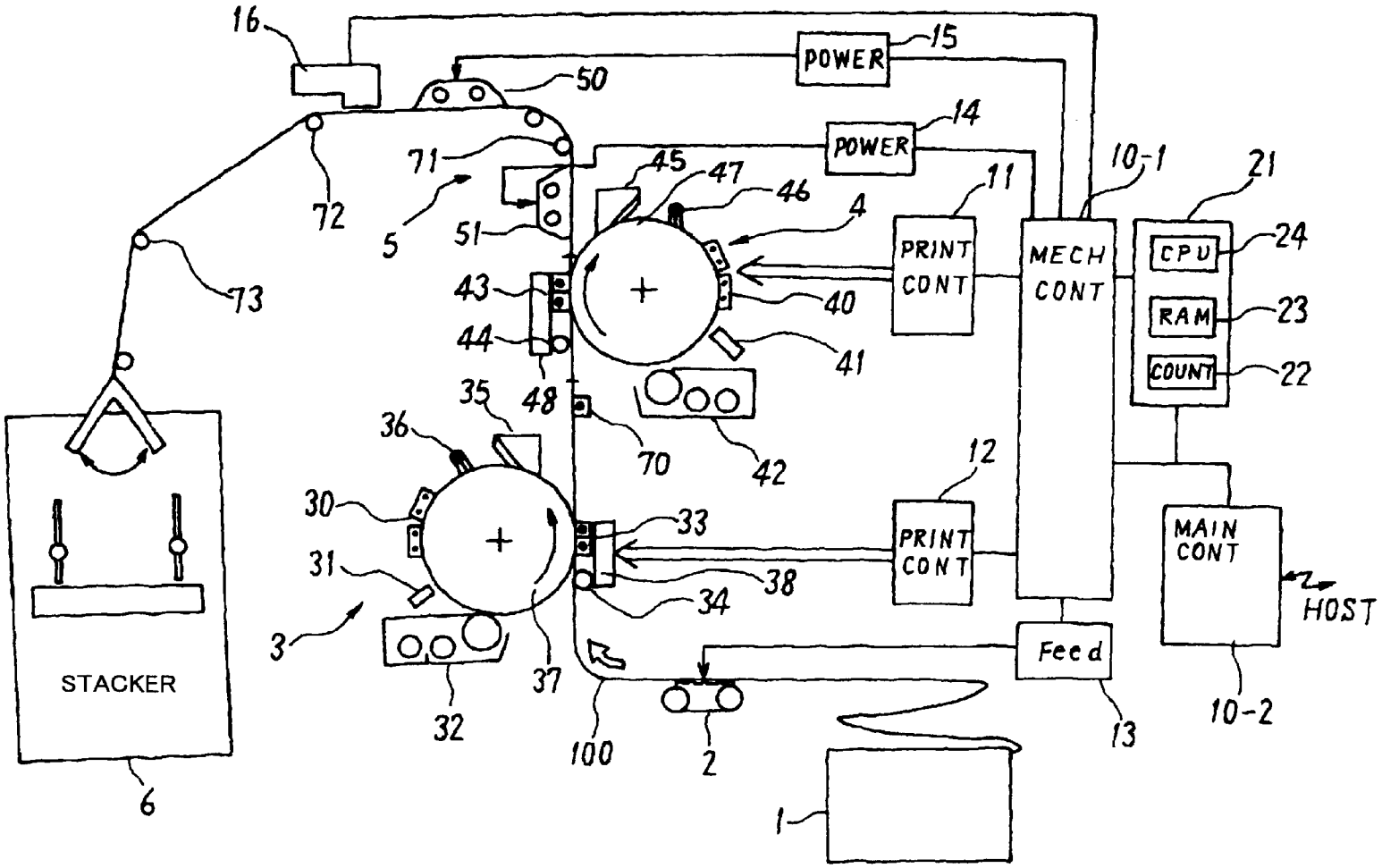
FIG. 16 is a schematic diagram of the printing device of the other embodiment of the invention.
Figure 17:
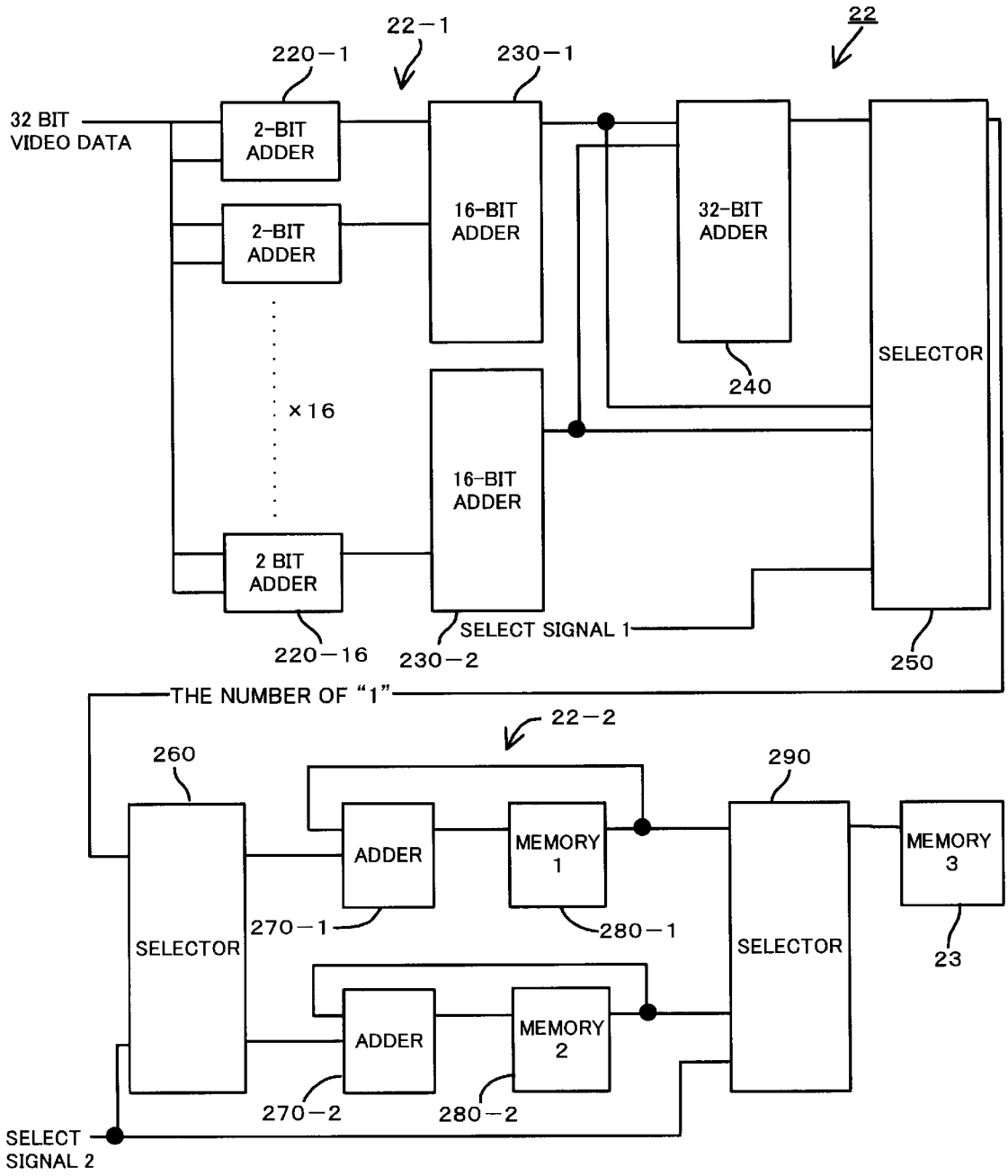
FIG. 17 is a schematic drawing of the print rate calculation circuit in FIG. 16.
Figure 18:
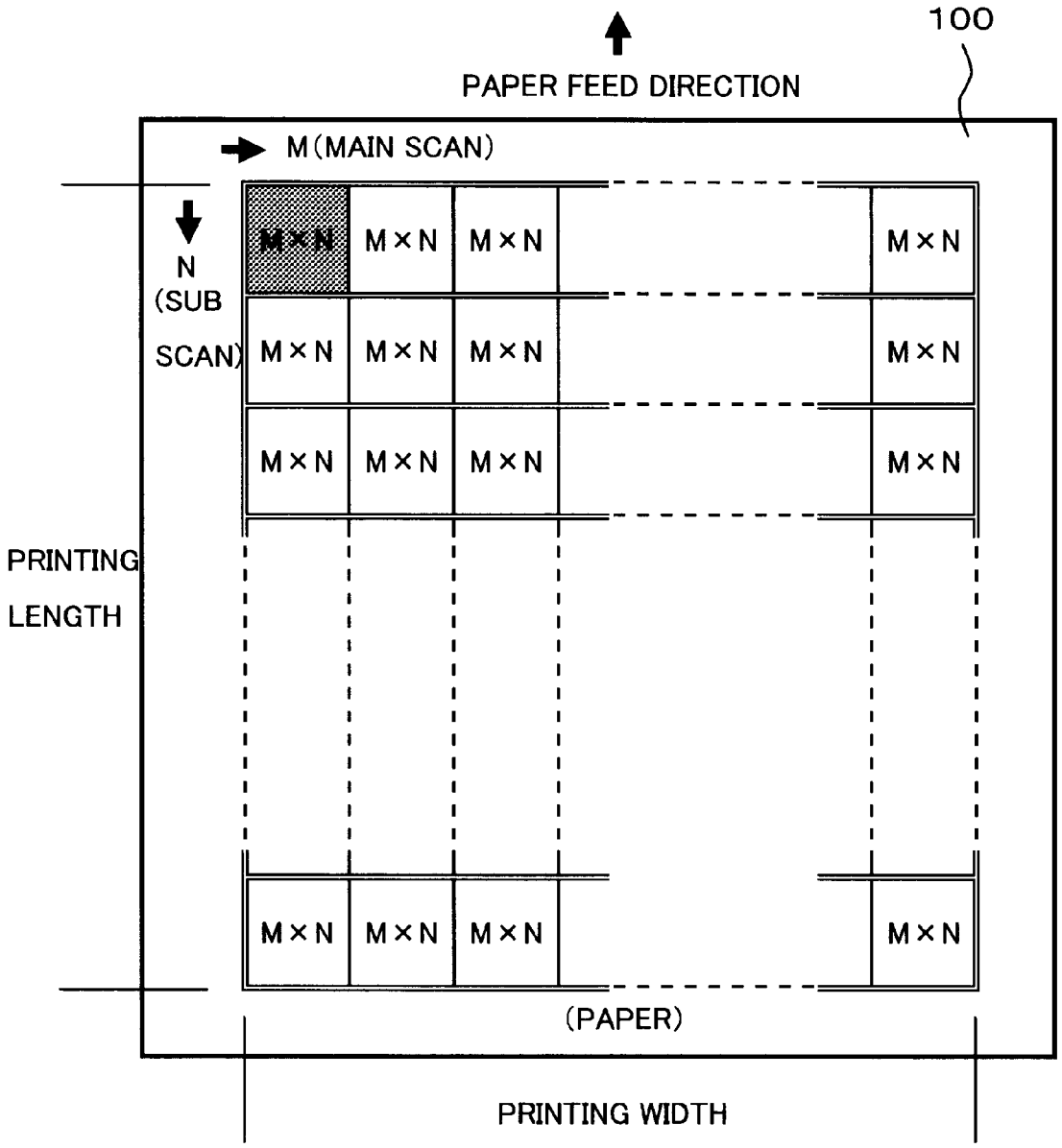
FIG. 18 is a drawing explaining the operation of the construction shown in FIG. 17.
Figure 19:
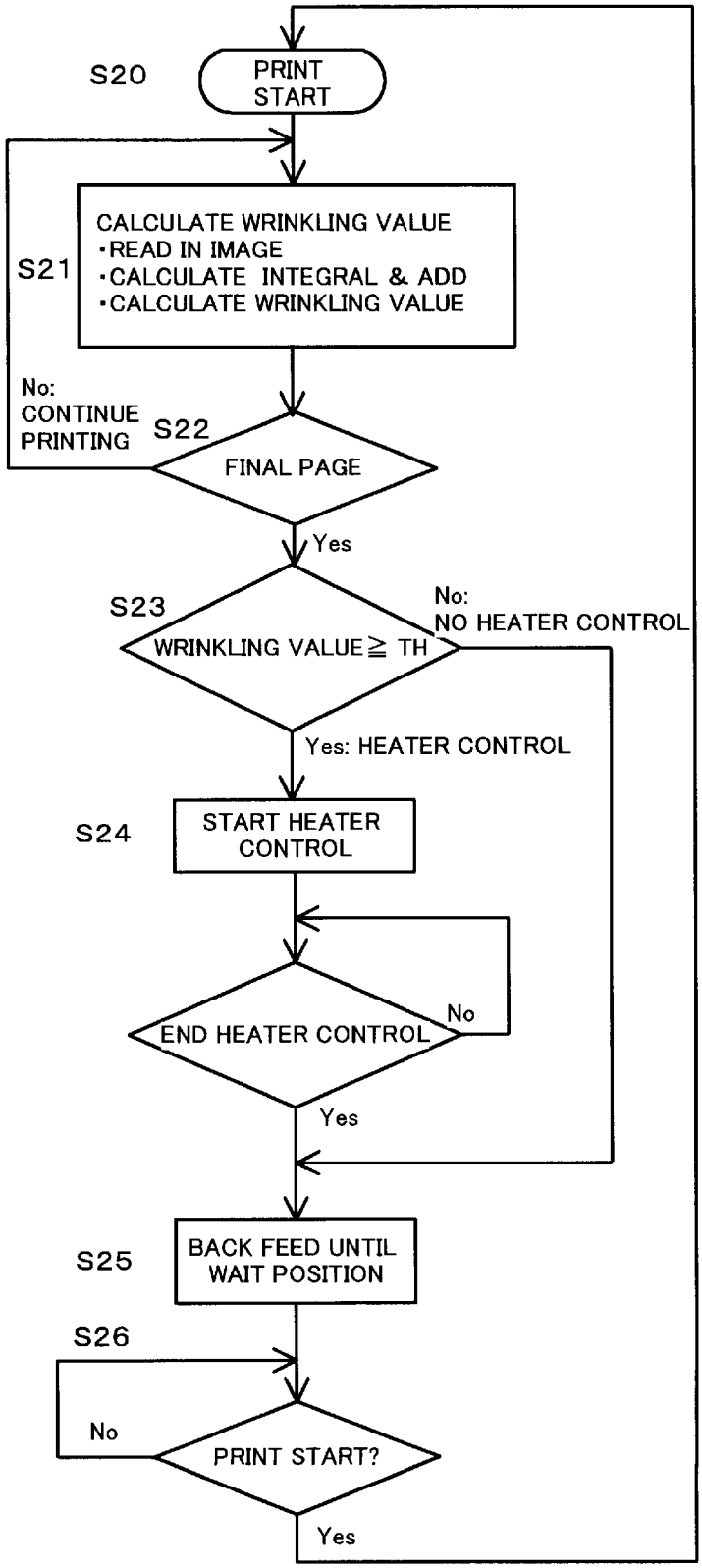
FIG. 19 is a flowchart of the printing process of the other embodiment of the invention.
Figure 20:
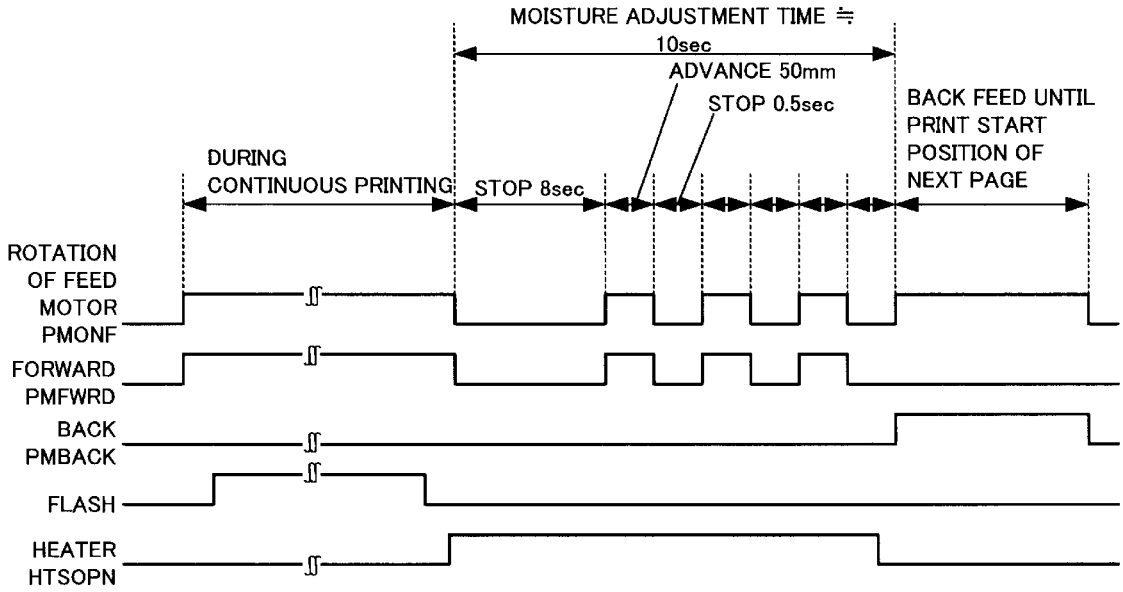
FIG. 20 is a drawing explaining the printing sequence, including the moisture-adjustment operation, of the other embodiment of the invention.
Figure 21:
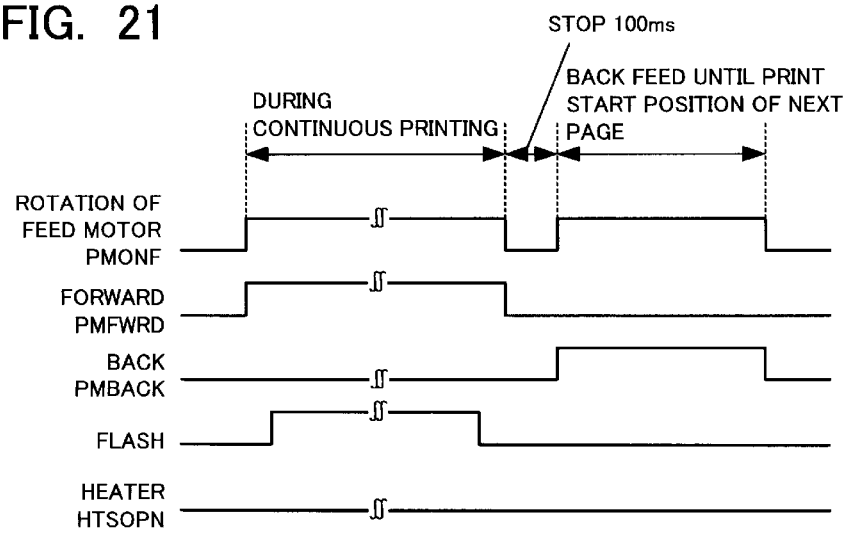
FIG. 21 is a drawing explaining the printing sequence, not including the moisture-adjustment operation, of the other embodiment of the invention.

FIG. 16 is a schematic drawing of the printing device of another embodiment of the invention, FIG. 17 is a schematic drawing of the printing rate calculation circuit in FIG. 16, FIG. 18 is a drawing explaining the printing rate calculation area, FIG. 19 is a process flowchart of the engine control unit in FIG. 16, and FIG. 20 and FIG. 21 are drawings explaining the operation sequence of the device in FIG. 16.

Figure 22:
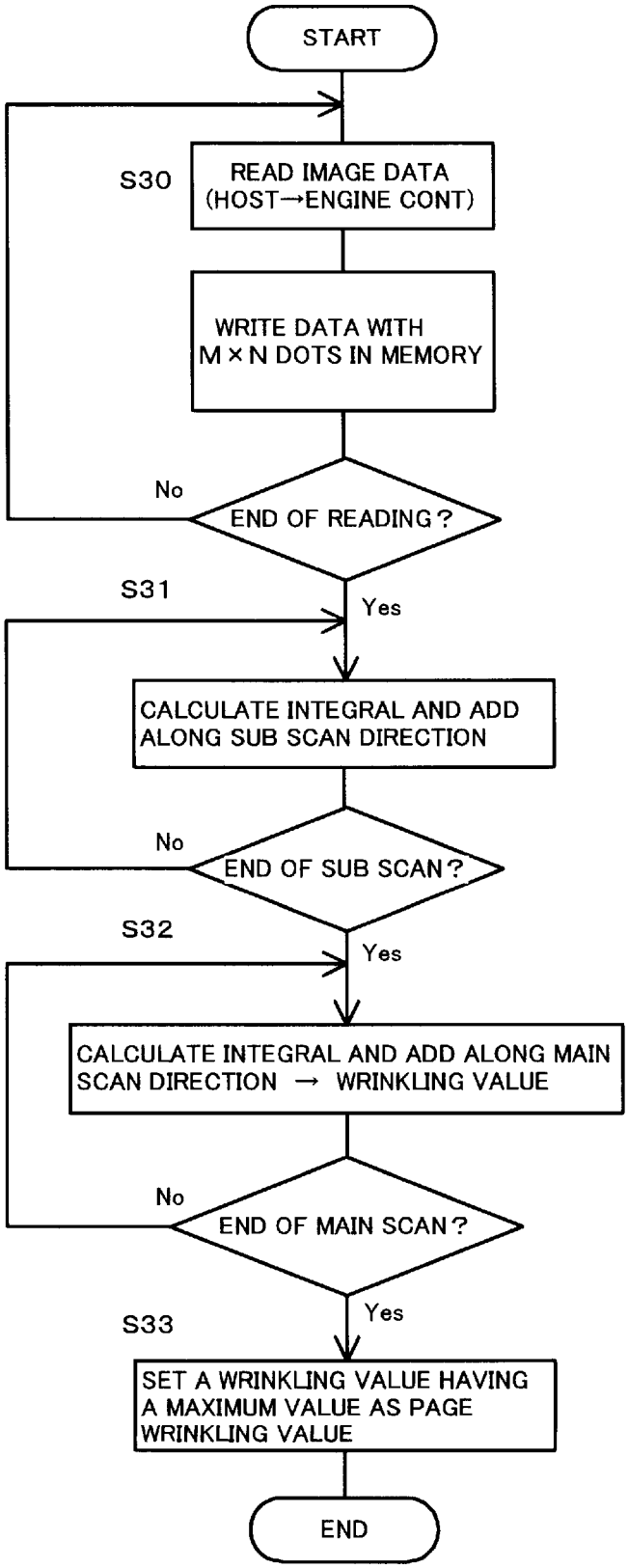
FIG. 22 is flowchart of the wrinkling value calculation process of the other embodiment of the invention.
Figure 23:
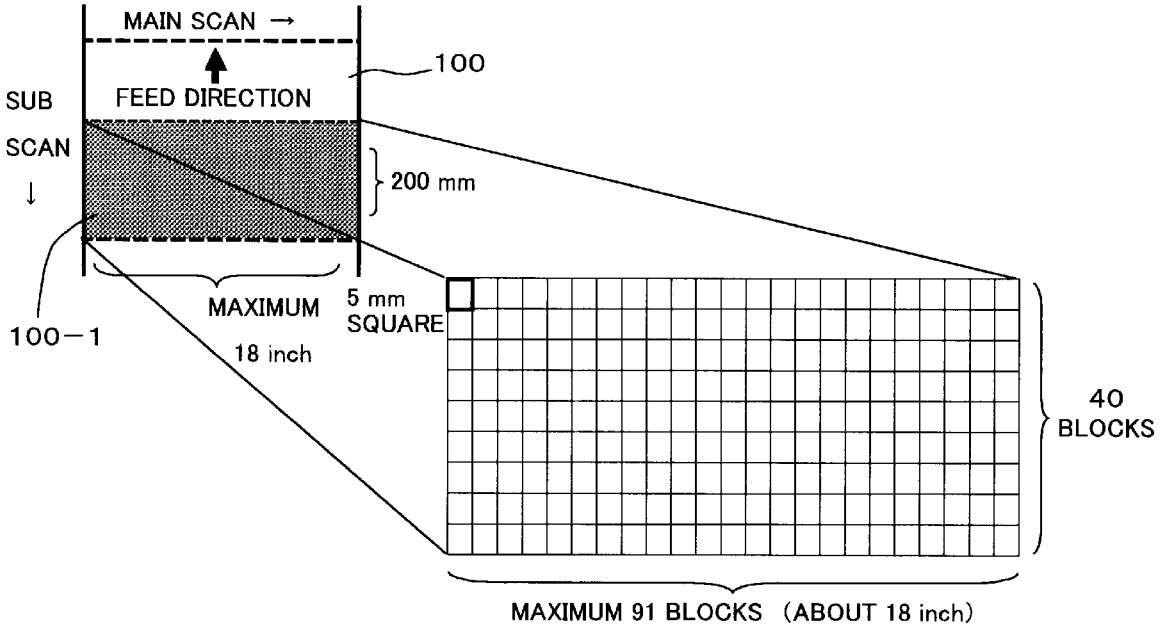
FIG. 23 is a drawing explaining the block density calculation process in FIG. 22.

FIG. 22 is a flowchart of the process for calculating the wrinkling value of the wrinkle detection circuit in FIG. 16, FIG. 23 is a drawing explaining the area for calculating the wrinkling value in FIG. 22, FIG. 24 and FIG. 25 are drawings for explaining the process for calculating the wrinkling value in FIG. 22, and FIG. 26 to FIG. 29 are drawings explaining the wrinkling detection process.

In FIG. 16, the parts that are the same as those shown in FIG. 1 are indicated with the same symbols. In other words, FIG. 16 shows a double-side printing device that prints on both sides of continuous paper having feed holes. There is a hopper 1 for holding the unprinted continuous paper 100. The continuous paper 100 has machine perforations on each page. A paper-feed tractor 2 meshes with the feed holes in the continuous paper 100 to move the continuous paper 100 in the direction of the arrow. A backside printing mechanism (second image formation unit) 3 comprises an electronic photograph printing mechanism that prints the backside of the continuous paper 100.

This backside printing mechanism 3 comprises a photo-sensitive drum 37, a charging device 30 for charging the photo-sensitive drum 37, and an LED head 31 for exposing a single-line optical image on the photo-sensitive drum 37. This LED head 31 comprises an array of a plurality of LEDs (light-emitting diodes) that are arrayed in one line.

A developer 32 develops the image on the photo-sensitive drum 37 with toner. A transfer charger 33 transfers the image developed on the photo-sensitive drum 37 to the backside of the continuous paper 100. A transfer-guide roller 34 pushes the continuous paper 100 against the photo-sensitive drum 37 during the transfer. A retractor mechanism 38 retracts the transfer-guide roller 34 when not performing transfer to prevent the photo-sensitive drum 37 from coming in contact with the continuous paper 100. A cleaner 35 recovers the residual toners from the photo-sensitive drum 37. A discharge lamp 36 discharges the residual potential on the photo-sensitive drum 37.

A front side printing mechanism (first image formation unit) 4 also comprises an electronic photographic printing mechanism. The front side printing mechanism 4 that prints the front surface of the continuous paper 11 is located downward from the backside printing mechanism 3 in the direction of flow of the paper.

This front side printing mechanism 4 comprises a photo-sensitive drum 47, a charging device 40 for charging the photo-sensitive drum 47, and an LED head 41 for exposing a single-line optical image on the photo-sensitive drum 47. This LED head 41 comprises an array of a plurality of LEDs (light-emitting diodes) that are arrayed in one line.

A developer 42 develops the image on the photo-sensitive drum 47 by toners. A transfer charger 43 transfers the image developed on the photo-sensitive drum 47 to the front side of the continuous paper 100. A transfer-guide roller 44 pushes the continuous paper 100 against the photo-sensitive drum 47 during the transfer. A retractor mechanism 48 retracts the transfer-guide roller 34 when not performing transfer to prevent the photo-sensitive drum 47 from coming in contact with the continuous paper 100. A cleaner 45 removes the residual toner from the photo-sensitive drum 47. A discharge lamp 46 discharges the residual potential on the photo-sensitive drum 47.

A neutralizing charger 70 is located between the backside printing mechanism 3 and the front side printing mechanism 4, and neutralizes the potential on the front side of the continuous paper 100 that was charged by the backside printing mechanism 3. This makes it possible for the transfer operation by the front side printing mechanism 4 to be performed stably.

A guide roller 71 changes the direction of the vertically fed continuous paper 100 to a horizontal direction. A fixation unit 5 comprises a pair of flash fixation units 50, 51. The flash fixation unit 50 fixes the toner image on the front side of the continuous paper 100 with a flash of light, and the flash fixation unit 51 fixes the toner image on the backside of the continuous paper 100 with a flash of light. A stacker 6 stacks the printed continuous paper 100. Scuff rollers 72, 73 direct the continuous paper 100 with the fixed image to the stacker 6.

A moisture adjustment mechanism 16 is located downward from the flash fixation unit 50, and it adjusts the amount of moisture in the continuous paper 100. It is as described previously with the use of FIG. 3.

A mechanism control unit 10 comprises a main-control unit 10-2, which controls the entire device according to printing instructions and printing data from the host computer, an engine-control unit 10-1, which controls the mechanisms of the printing device according to instruction from the main-control unit, and a wrinkling-detection unit 21, which detects poor toner transfer due to wrinkling of the last page.

A first printing-control unit 11 controls the front-side printing mechanism 4 according to an instruction from the engine-control unit 10-1. A second printing-control unit 12 controls the backside printing mechanism 3 according to an instruction from the engine-control mechanism 10-1. A paper-feed control unit 13 controls the feed tractor 2 according to an instruction from the engine-control unit 10-1.

A first flash power supply 15 is controlled by the engine-control unit 10-1, and controls the flash of light from the first flash fixation unit 50. A second flash power supply 14 is controlled by the engine-control unit 10-1, and controls the flash of light from the second flash fixation unit 51.

The wrinkling detection unit 21 comprises a printing rate calculation circuit 22 (described later in FIG. 17) that calculates the printing rate (dot density) of printing data from video data from the main-control unit 10-2, memory 23, and processor 24, that takes the product of the printing rate of the page just before printing stops, and a coefficient, which takes into consideration that the effect of wrinkling on the next page is larger at the end of the paper when printing stops, and calculates the wrinkling value, and then gives the instruction for the wrinkle smoothing operation when the calculated wrinkling value is larger than a set threshold value.

As shown in FIG. 12, the engine-control unit 10-1, in response to the wrinkle smoothing instruction, prevents the occurrence of wrinkling of the paper due to the shrinkage of toner, by blowing hot air on the first page of the next job with the heater unit 16, after the last page of printing passes the flash lamp 2, to remove the moisture from the paper.

The printing rate calculation circuit 22 in FIG. 16 will be explained with the use of FIG. 17 and FIG. 18. First, as shown in FIG. 18, the printing area of each page of the continuous paper 100 is divided into sections, M dots in the main scanning direction and N dots in the sub-scanning direction, and the number of black dots inside each section (M×N dots) is counted. In this embodiment, M×N is selected to be 16×16 or 32×32 depending on the printing resolution.

As shown in the schematic drawing of the printing rate calculation circuit 22 in FIG. 17, the calculation circuit 22 comprises a main-scan counting circuit 22-1, that counts the number of black dots for each M dot of each raster, and a sub-scan counting circuit 22-2, that adds the number of black dots for each M dot of each raster to the N dots in the sub-scanning direction.

The main scanning counting circuit 22-1 comprises a three-stage adder. In order to calculate the number of '1' (black dots) in video data with a 32-bit video data width, 16 numbers 2-bit adders 220-1 to 220-16 are used in the first-stage adder, and they add video data two bits at a time, and calculate the number of '1' for every two bits.

In the two-stage adder, two adders 230-1, 230-2 are used for calculating the number of '1' in the 16-bit video data, and in the three-stage adder one adder 240 is used to add the addition results of the adders 230-1, 230-2.

A selector 250 selects whether to use the calculation results for every 16 bits or every 32 bits as the calculation results for the number of '1'. In this way, it is made possible to select 32-bits or 16-bits depending on the printing resolution.

Next, the sub-scanning count circuit 22-2 has two memories 280-1, 280-2. The memories 280-1, 280-2 are initialized and all of the data are made '0'. Memory 280-1 counts the address starting from address $0 until there is 1 raster of data, and the calculation results of the number of '1s' is stored for each address.

After one raster of data is collected, the address returns to address $0, and the data for the second raster are stored. When doing this, the data for the first raster and the data for the second raster, that are stored in memory 280-1, are added by an adder 270-1, and the result is stored in memory 280-1.

This operation is repeated until the selection signal 2 changes, and when it changes, memory 280-2 performs the same operation. While data are stored in memory 280-2, the calculation result of the number of '1' of 16×16 or 32×32 dots that was stored in memory 280-1 is stored in memory 23. After the result is stored in memory 23, the data of memory 280-1 are initialized to '0'.

Next, when the selection signal 2 has changed, data from memory 280-2 is stored in memory 23, and then the calculation results for the number of '1' in the next raster begin to be stored in memory 280-1.

This operation is repeated and the calculation results for the number of '1' for 16×16 dots or 32×32 dots are stored in memory 23, and when the addresses in memory 23 become full, then data is overwritten beginning from address $0. Memory 23 is a memory with sufficiently large capacity for detecting wrinkling, and stores the calculation results (printing rate) of the number of '1' for each division of the page in FIG. 18.

Next, a printing device that uses this calculated printing rate is explained with the use of FIG. 19, FIG. 20 and FIG. 21.

(S20) Printing starts. In other words, as in steps S2 to S5 described above in FIG. 5, when received a 'Start Job' instruction from the host, the main control unit 1-02 sends video data for each page to the engine-control unit 10-1, and starts operation of the front side printing mechanism and backside printing mechanism 3 by way of both printing control units 11, 12. From this, the photo-sensitive drums 37, 47 turn and a toner image is formed on the photo-sensitive drums 37, 47 according to the printing data (LED writing in FIG. 7 starts). Next, the engine-control unit 10-1 starts moving the continuous paper 100 forward by way of the feed-control unit 13. In this way, the continuous paper is fed in the forward direction (direction of the arrow in FIG. 16). Together with this, the engine-control unit 10-1 starts contact between the paper and the photo-sensitive drums 37, 47 by way of the retractor mechanisms 38, 48 and transfer guide. Therefore, toner images are formed on both sides of the continuous paper 100. Furthermore, the engine-control unit 10-1 starts the flash. By doing this, the power supplies 14, 15 are connection to the external power supply 17, and the flash lamp of the flash fixation units 50, 51 generate flashes of light at set intervals by the charge and trigger discharge described above. In this way, the toner images are fixed to the continuous paper 100.

(S21) At the wrinkling detection unit 21 described above, video data (image data) are fetched from the main control unit 10-2, and the printing rate counting circuit 22 calculates the printing rate and writes it to memory 23, and the processor (CPU) 24 calculates the wrinkling value that is described below using FIG. 22. The wrinkling value is a numerical value given to the phenomenon that causes the wrinkling that occurs on the paper of the last page to be carried over to the next page, which causes poor toner transfer.

(S22) When the main control unit 10-2 receives an 'End Job' (end printing) instruction from the host, LED writing on the photo-sensitive drums 37, 47 ends (see FIG. 37). Then, as shown in FIG. 7 and FIG. 8, the last printed page 'e' of that job is fixed. In addition, the engine-control unit 10-1 turns OFF the flash. In other words, the engine-control unit 10-1 turns OFF the switch 18. By doing this, the flash of light FLASH stops, as shown in FIG. 20 and FIG. 21.

(S23) Together with this, the processor 24 determines whether the wrinkling value for this last page is greater than the threshold value. When the wrinkling value is greater than the threshold value, the processor 24 instructs the engine-control unit 10-1 to perform the wrinkle smoothing operation, and when the wrinkling value is less than the threshold value, the processor 24 gives an instruction that the wrinkle smoothing operation is not necessary.

(S24) When the engine-control unit 10-1 is instructed that the wrinkle smoothing operation is not necessary, the process advances to step S25. However, when the engine-control unit 10-1 receives a wrinkle smoothing instruction interrupt, it turns ON the moisture-adjustment mechanism (fan) 16. In other words, the engine-control unit 10-1 opens the shutter 162 shown in FIG. 3. At this time, the power is turned ON and the fan 160 and halogen lamp 161 are turned ON. Therefore, the hot air from the moisture-adjustment mechanism 16 is blown over the continuous paper 100. As shown in FIG. 20, the stopped continuous paper is fed forward, and hot air is blown over the page 'd', following the last page 'e'.

To blow this hot air, first, the start of the next page stops at the outlet (range of 50 mm) for the hot air that is blown from the shutter 162 and the page is blown by the hot air for 8 seconds. Next, the continuous paper 100 is fed forward 50 mm, and is blown with hot air for 0.5 seconds. The continuous paper is then fed another 50 mm and is blown with hot air for another 0.5 second. The continuous paper 100 is then fed another 50 mm and stops. In this way, as shown in FIG. 12, it is possible to adjust the amount of moisture of the first page d of the continuous paper so that it not as little as the amount of moisture of the starting area 'L1' of the next page 'd', however is near the amount of moisture of the last page 'e'. Next, the engine-control unit 10-1 turns OFF the moisture-adjustment mechanism (fan) 16. In other words, closes the shutter 162 in FIG. 3.

(S25) The engine-control unit 10-1 starts the tractor 2 by way of the feed-control unit 13 in order to move the continuous paper 100 backward. In addition, as shown in FIG. 10, the continuous paper 100 stops at a position where it is possible the photo-sensitive drum of the backside printing unit 3 to transfer toner to the next page 'd' (start of the next job) after the last page 'e'. Moreover, the next job can start printing from the next page 'd' after the last page 'e'. Also, both image formation units 3, 4 stop. This is the end of that job and the printing devices waits for the next job.

(S26) The mechanical-control unit 10 waits for a command from the host. When the mechanical-control unit 10 receives a command to start the next printing job, the process returns to step S20 described above.

In this way, the printing status of the last page of the job is analyzed, and from the printing status, it is determined whether or not the wrinkling (shrinkage) due to the printing toner on the last page will cause poor toner transfer due to wrinkling of the first page of the next job. When there is a possibility that poor toner transfer will occur, then as shown in FIG. 20, the wrinkle smoothing operation is performed. However, when there is no possibility that there will be poor toner transfer, then as shown in FIG. 21, feedback starts right away without the wrinkle smoothing operation being performed.

Therefore, the wrinkle smoothing operation is only performed when there is a possibility of poor toner transfer, so it is possible to prevent poor toner transfer to the first page of the next job, and since feedback is performed immediately without performing the wrinkle smoothing operation when there is not possibility of poor toner transfer, high-speed, continuous printing jobs are possible.

Next, in this embodiment, when printing is stopped, the wrinkling value is calculated by using the contents of the memory 23. In this case, it is also possible to read the printing result (image printed on the paper) and calculate the wrinkling value. In that case, as a means for reading, it is necessary to have an optical sensor or the like for reading the image.

On the other hand, in this embodiment, the video data sent from the controller 10-2 is read and the wrinkling value is calculated, so there is no need for a sensor, making it possible to reduce the cost of the printing device. Moreover, in the case of a normal printer, the maximum width of the paper with respect to the paper-feed direction is 18-inches, so it is difficult to maintain space for mounting a sensor. However, by reading video data sent from the controller, there is no need for space to mount a sensor.

Furthermore, in a printer that uses the flash fixation method, in the case of reading the image that is printed on the paper with a sensor, when the printed image is read when the light flashes, it is difficult for the sensor to accurately read the image due to the effects of the flash of light. Therefore, the sensor could only be installed at a location where it would not be affected by the flash of light. However, in the method of reading video data, there is no effect from the flash of light.

Also, In order to avoid the effects of the flash of light, it is necessary to have a control circuit for reading the image printed on the paper at timing that is offset from the phase of the flash cycle. However, in the method of reading video data, since there is not effect from the flash of light, there is no need for a circuit for reading the image at timing offset from the phase of the flash cycle.

Furthermore, in the method of calculating the wrinkling value from reading image printed on the paper, the wrinkling value must be calculated within the time from when the image was read until printing stops, so the time allowed for calculation is short. However, in the method of calculating the wrinkling value from reading video data, the amount of time from when the video data is received until the image is read, and the time that can be used for calculating the wrinkling value is long compared with the method of reading the printed image (calculation results of the wrinkling value can be output quickly). In the case that the time from when the image on the photo-sensitive drum is transferred to the paper and the paper reaches the printing stop position is short (distance is short, the printing speed is fast, etc.), there is a possibility that there will not be enough time to calculated the wrinkling value after the image has been read, however in this embodiment, this problem has been solved.

Next, the calculation of the wrinkling value in FIG. 19, described above, and the detection of the pattern that causes wrinkling, are explained based on FIG. 22 and in reference to FIG. 23 to FIG. 25.

(S30) The printing rate of the area M×N is calculated with the printing rate calculation circuit 22 described above, and the value is written in memory 23.

(S31) The processor 24 calculates the wrinkling value from this printing rate. First, as shown in FIG. 23, the processor 24 divides the area near the end of printing 100-1 into a 5×5 mm block, and calculates the density of the dots inside that block. Since this detection calculation does away with differences for each resolution, it is performed in mm units. The area for which the calculation is performed, is a rectangular area that has a sub-scanning direction that is 200 mm (40 blocks) from the end of the page affected with wrinkling, and a main scanning direction that is the printing width.

When the printing length is less than 200 mm, the calculation is performed for 200 mm printing length which includes the previous printing data. However, when the printing length for the first printing job after the power has been turned ON is less than 200 mm, then the insufficient range is calculated as blank paper.

The dot density indicates the ratio of dots in the 5×5 mm block, however, since the number of dots inside the 5×5 mm block differs depending on the resolution (for example 240 dpi or 400 dpi), the difference for each resolution is done away with by multiplying the value with a coefficient for each resolution. The maximum number of blocks in the main scanning direction is 91 blocks (approximately 18 inches).

Figure 24A:
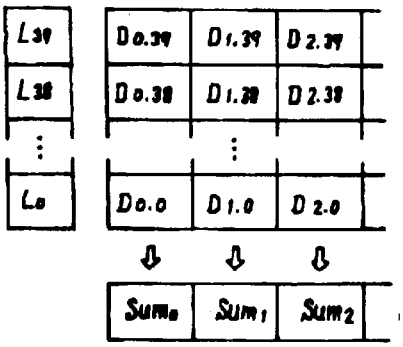
FIG. 24 is a drawing explaining the coefficient computation operation in the sub-scan direction in FIG. 22.
Figure 24B:
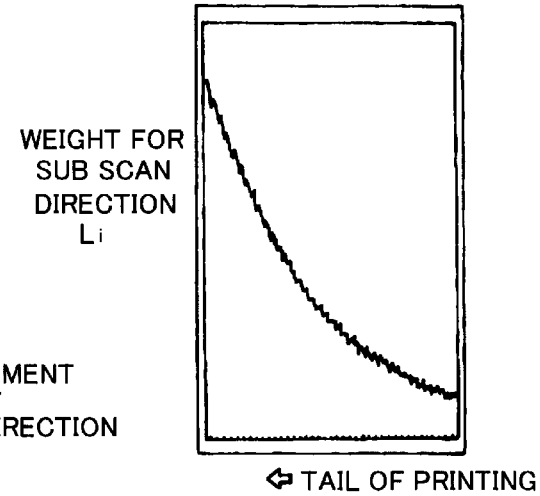

Next, as shown in FIG. 24A, the processor 24 calculates the sum of products of the dot density D(x,i) inside the 5×5 mm block and the sub-scanning direction weighting coefficient Li that changes in the sub-scanning direction (see the equation below), and stores it in a one-dimensional array Sumx. The sub-scanning direction weighting coefficient Li is a coefficient for detecting the effect in the sub-scanning direction, and as shown in FIG. 24B, a coefficient with a large value is used because the effect on wrinkling near the end of the paper is large.

$$\mathrm{Sum}x=\Sigma(Li\times D(x,i))$$

Figure 25A:
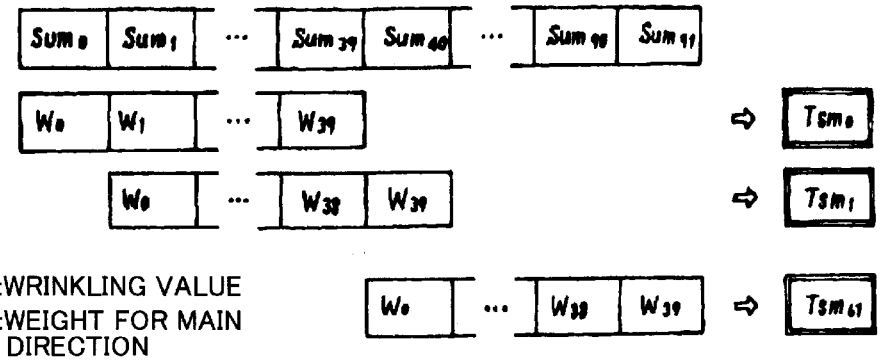
FIG. 25 is a drawing explaining the coefficient computation operation in the main-scan direction in FIG. 22.

(S32) As shown in FIG. 25A, the sum of products of the one-dimensional array Sumx that was calculated instep S31, and the main scanning direction weighting coefficient W1, that changes in the main scanning direction, is calculated using the equation below as the wrinkling value. The range of the main scanning direction weighting coefficient is the same 200 mm (40 blocks) of the range of the sub-scanning weighting coefficient, and it is calculated for the entire area by moving the starting position of the sum of products of the one-dimension array Sumx one block at a time.

$$Tsmx=\Sigma(Wi\times \mathrm{Sum}x)$$

Figure 25B:
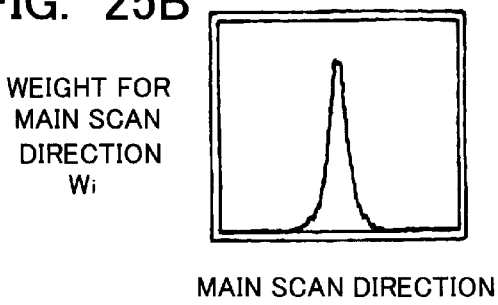

The main scanning direction weighting coefficient Wi is a coefficient for detecting the continuity of printing in the main scanning direction, and since the effect on wrinkling is higher the more continuity there is, then, as shown in FIG. 25B, coefficients are used where the middle coefficient value is large.

(S33) The maximum value of the calculated wrinkling value Tsmx is set as the wrinkling value for this page, and ends. The wrinkling value for the page and the threshold value are compared, and when it appears that the wrinkling value is larger than the threshold value, the heater is turned ON.

Figure 26:
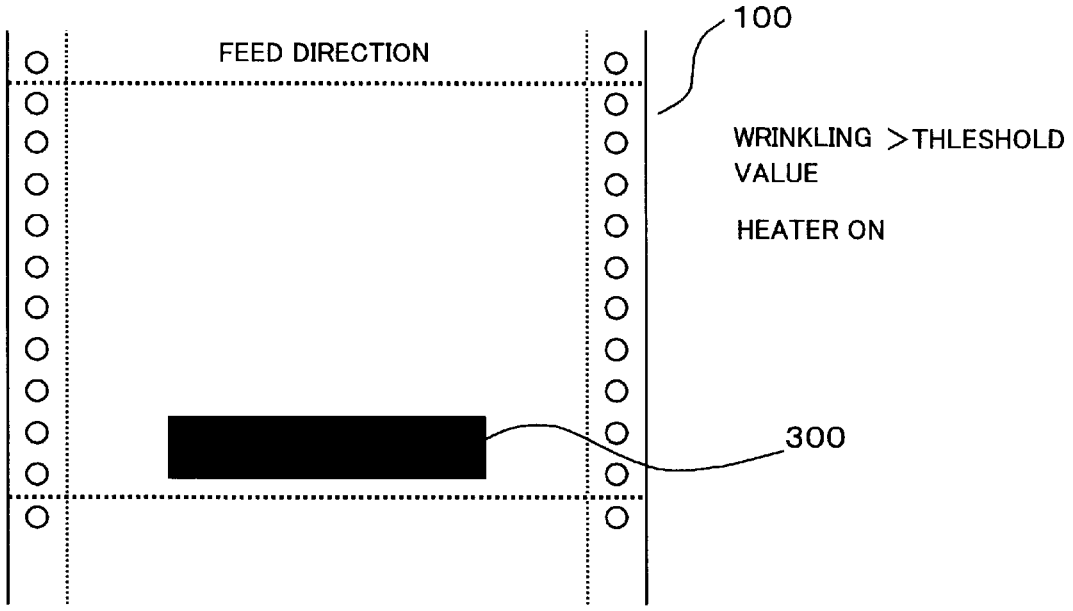
FIG. 26 is a drawing explaining the wrinkle pattern detection operation (1/6).
Figure 27:
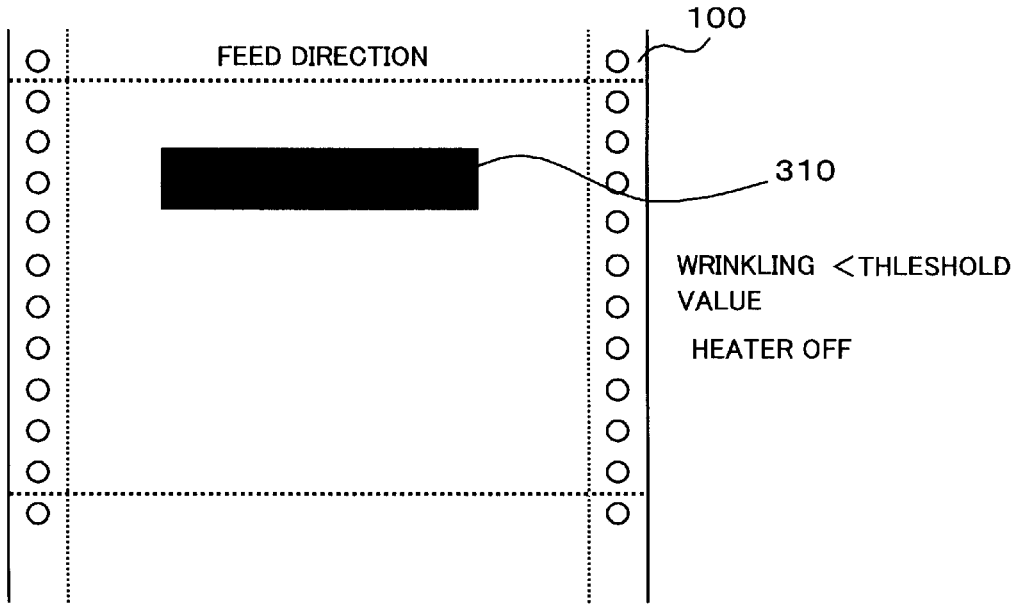
FIG. 27 is a drawing explaining the wrinkle pattern detection operation (2/6).
Figure 28:
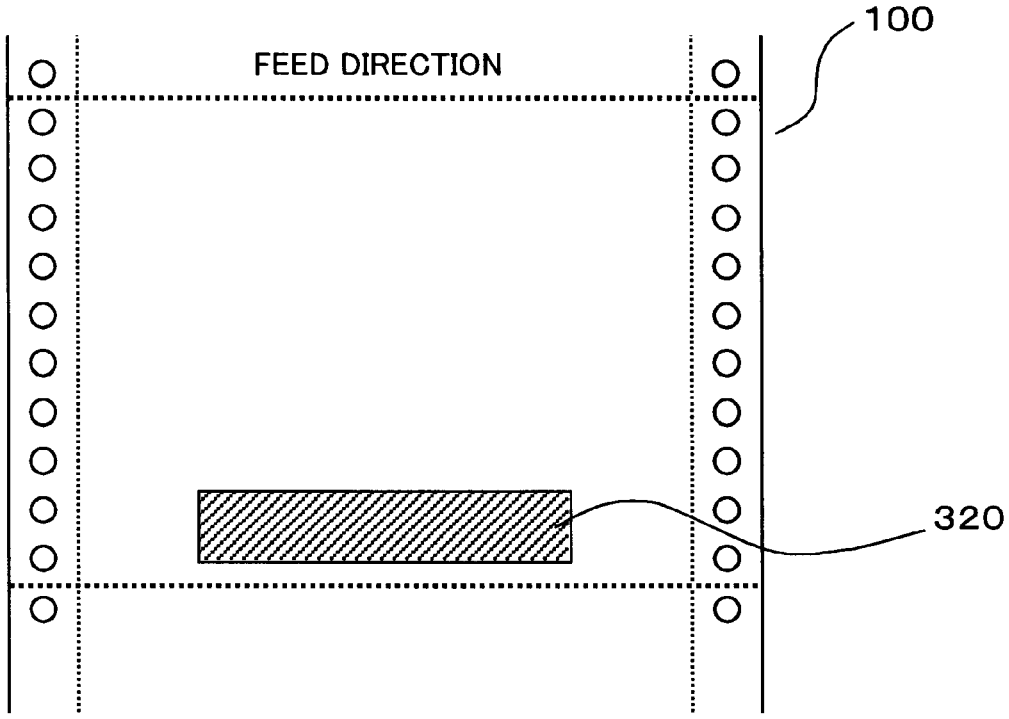
FIG. 28 is a drawing explaining the wrinkle pattern detection operation (3/6).

This example of detecting the wrinkling pattern is explained using FIG. 26 thru FIG. 31. As shown in FIG. 26, when there is a highly dense continuous pattern 300 of dots at the end of the paper 100, the wrinkling value is greater than the threshold value, and the wrinkling on the paper 100 affects the transfer of toner to the next page, so heater control is performed. On the other hand, as shown in FIG. 27, when there is a continuous pattern 310 with the same high-density of dots, but that is located at the beginning of the paper 100, then the wrinkling value is less than the threshold value, and wrinkling of the paper 100 does not affect the transfer of toner to the next page, so heater control is not performed. Furthermore, as shown in FIG. 28, even when there is a continuous patter of dots at the end of the paper 100, when the pattern 320 is not dense, then the wrinkling value is less than the threshold value, and wrinkling of the paper 100 does not affect the transfer of toner to the next page, so heater control is not performed. This control function according to the coefficient for the sub-scanning direction.

Figure 29A:
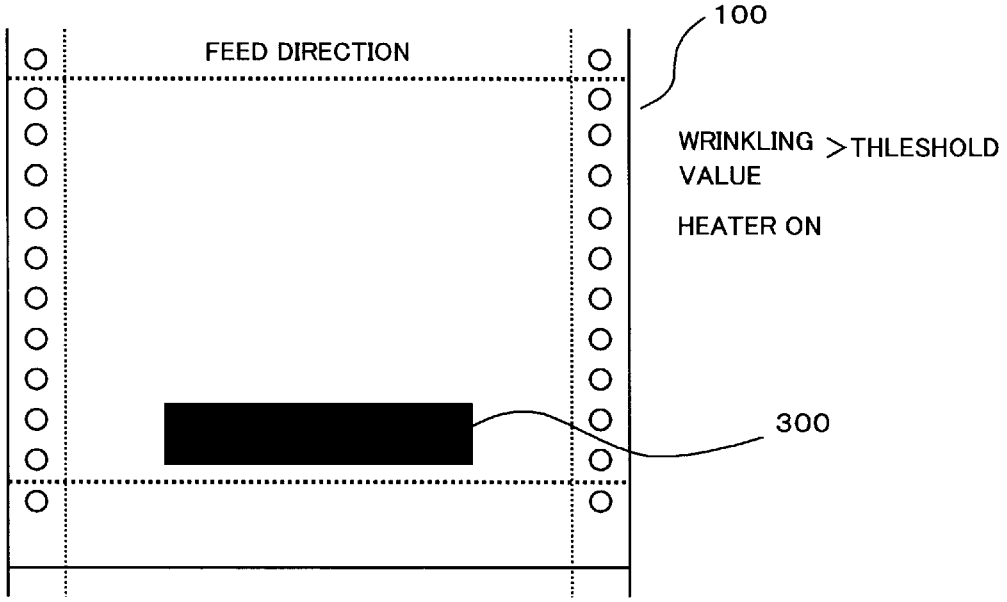
FIGS. 29A and 29B are drawing explaining the wrinkle pattern detection operation (4/6).
Figure 29B:
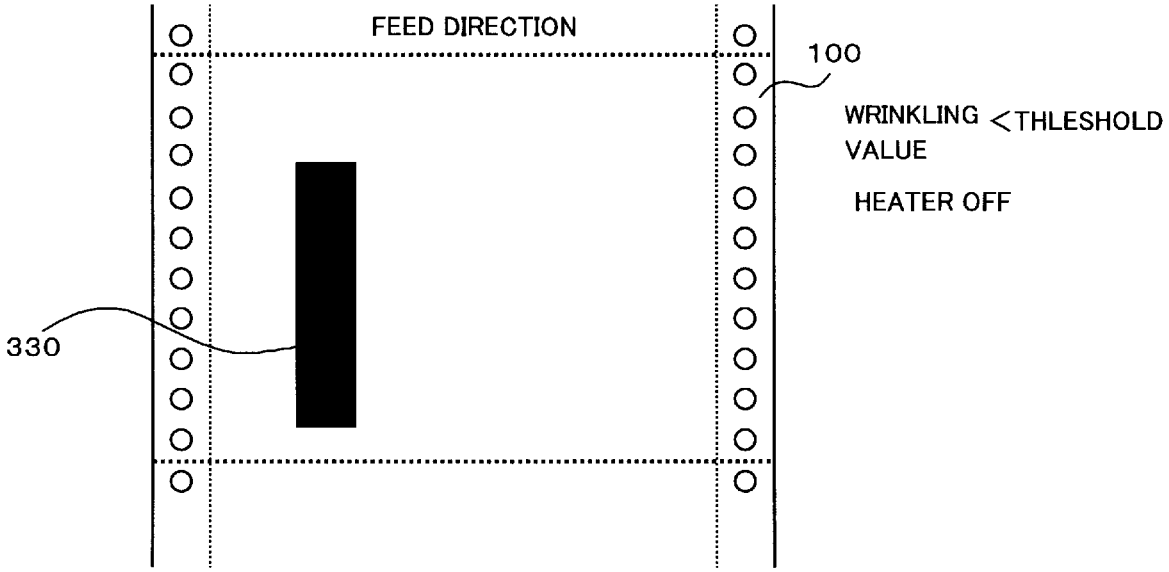

As shown in FIG. 29A, when the highly dense continuous pattern 300 of dots extends in the main scanning direction at the end of the paper 100, the wrinkling value is greater than the threshold value, and wrinkling of the paper 100 affects the transfer of toner to the next page, so heater control is performed. On the other hand, as shown in FIG. 29B, when there is a continuous pattern 310 with the same high-density of dots, that extends in a sub-scanning direction other than the main scanning direction of the paper 100, the wrinkling value is less than the threshold value, and wrinkling of the paper 100 does not affect the transfer of toner to the next page, so heater control is not performed.

Figure 30A:
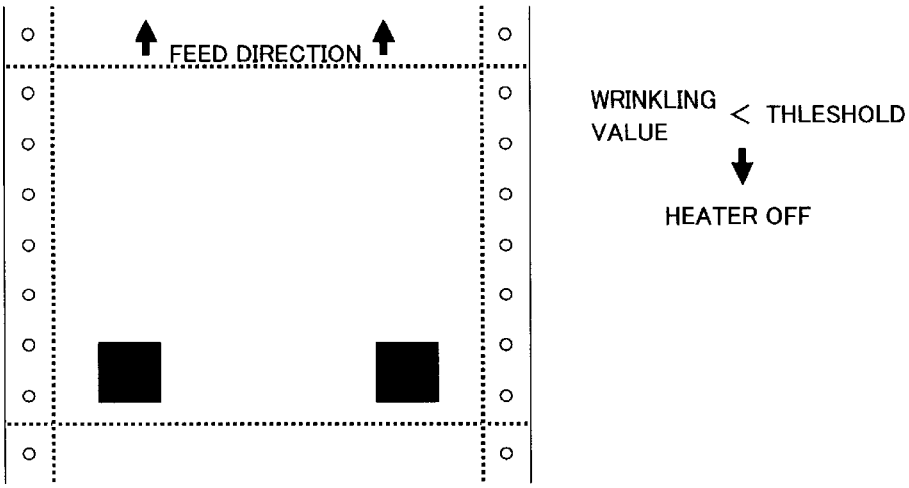
FIGS. 30A, 30B and 30C are drawing explaining the wrinkle pattern detection operation (5/6).
Figure 30B:
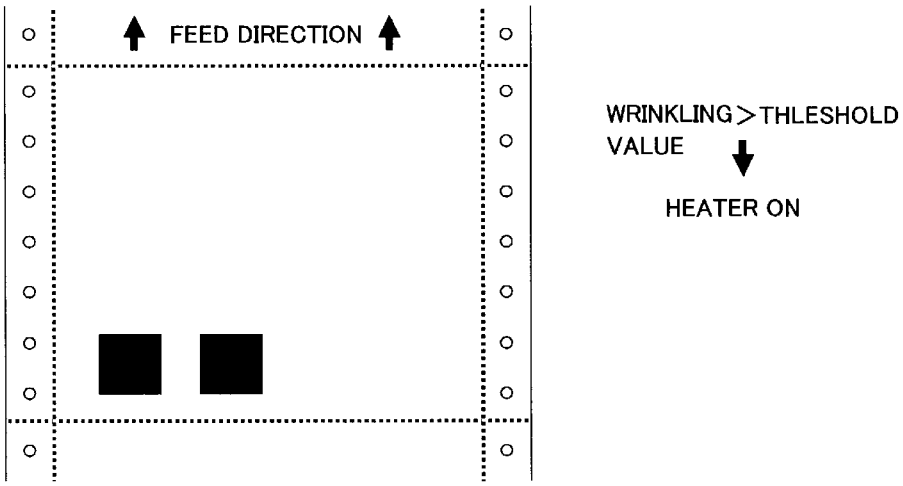
Figure 30C:
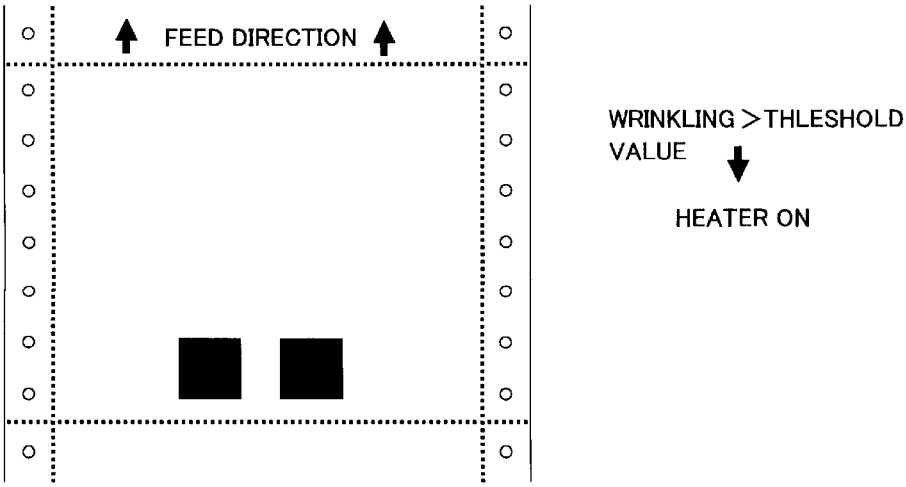

As shown in FIG. 30A to FIG. 30C, when there is a plurality of images that are the same size and with the same density, and when the distance between the images is close, as shown in FIG. 30B and FIG. 30C, then the wrinkling value is greater than the threshold value, and wrinkling of the paper 100 affects the transfer of toner to the next page, so heater control is performed. On the other hand, when the distance between images is far, the wrinkling value is less than the threshold value, and wrinkling of the paper 100 does not affect the transfer of toner to the next page, so heater control is not performed. These controls function according to the coefficient for the main scanning direction.

Figure 31A:
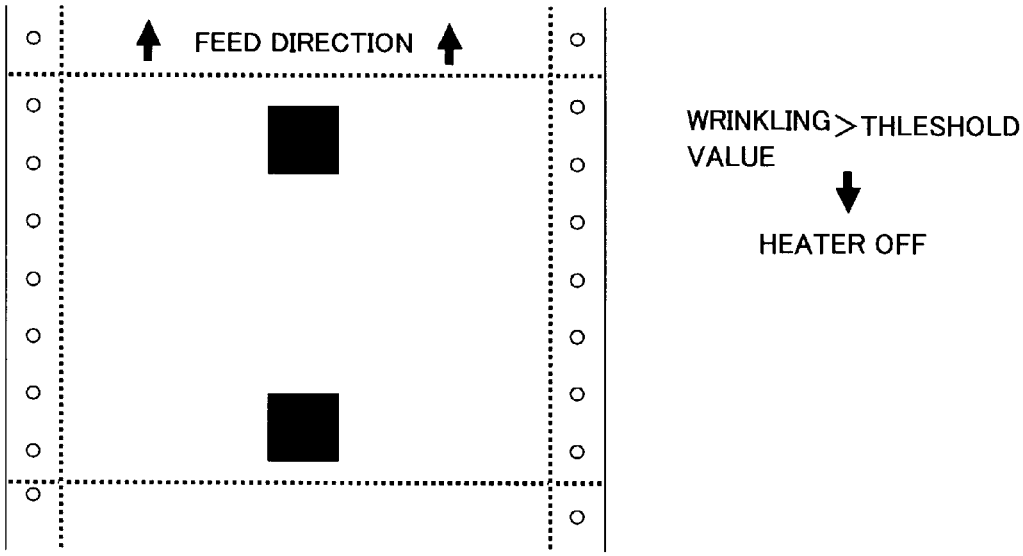
FIGS. 31A and 31B are drawing explaining the wrinkle pattern detection operation (6/6).
Figure 31B:
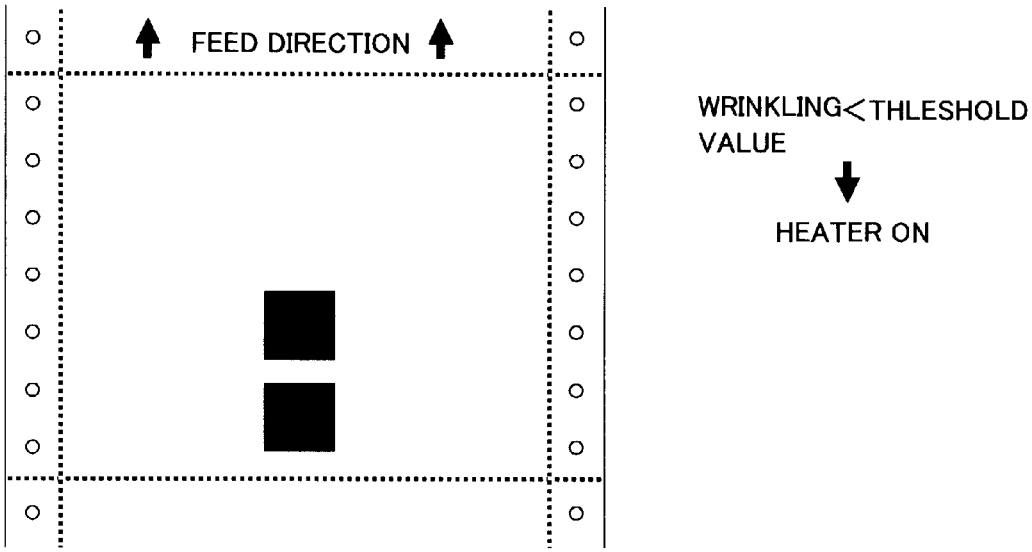

Similarly, as shown in FIG. 31A and FIG. 31B, when there is a plurality of images that are the same size and with the same density, and when the distance between the images in the sub-scanning direction is close, as shown in FIG. 31B, then the wrinkling value is greater than the threshold value, and wrinkling of the paper 100 affects the transfer of toner to the next page, so heater control is performed. On the other hand, as shown in FIG. 31A, when the distance between images in the sub-scanning direction is far, the wrinkling value is less than the threshold value, and wrinkling of the paper 100 does not affect the transfer of toner to the next page, so heater control is not performed.

In this way, when looking at the entire page, the closer the printing pattern is to the end of the paper, the easier it becomes for wrinkling of the next page to occur, and even for a printing pattern with the same density, the further the pattern extends in the main scanning direction, the easier it becomes for wrinkling of the next page to occur, and even for a plurality of images, the closer the images are together, the easier it becomes for wrinkling of the next page to occur.

In this embodiment, for these reasons, not only is the density at the end of the paper observed, but also the entire page as well, and calculation is performed using coefficients that change for the main scanning direction and sub-scanning direction. Therefore, it is possible to accurately determine the possibility of poor toner transfer to the next page.

In addition, the wrinkling detection circuit 21 described above is separate from the engine-control unit 10-1 and can be provided as an option. In other words, this embodiment can be provided to just those users that desire to prevent poor toner transfer as well as have high-speed printing of course, it is possible to perform this process of wrinkle detection with the main control unit 10-2 and engine-control unit 10-1.

[Further Embodiment]

Figure 32:
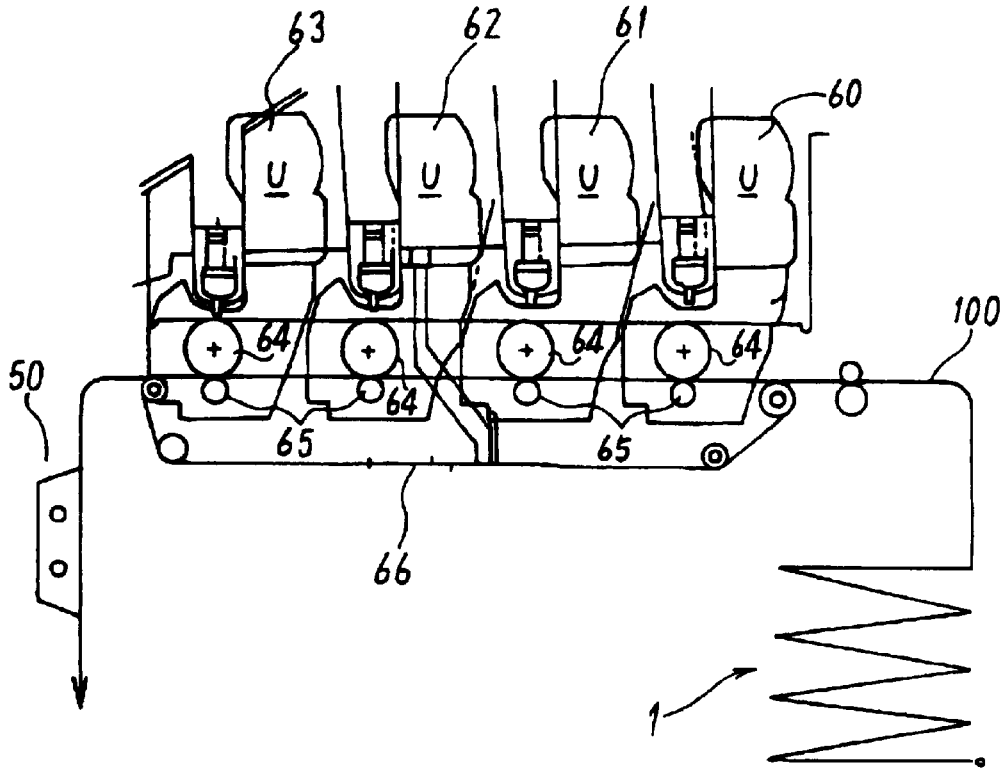
FIG. 32 is a schematic drawing of the printing device of further embodiment of the invention.
Figure 33:
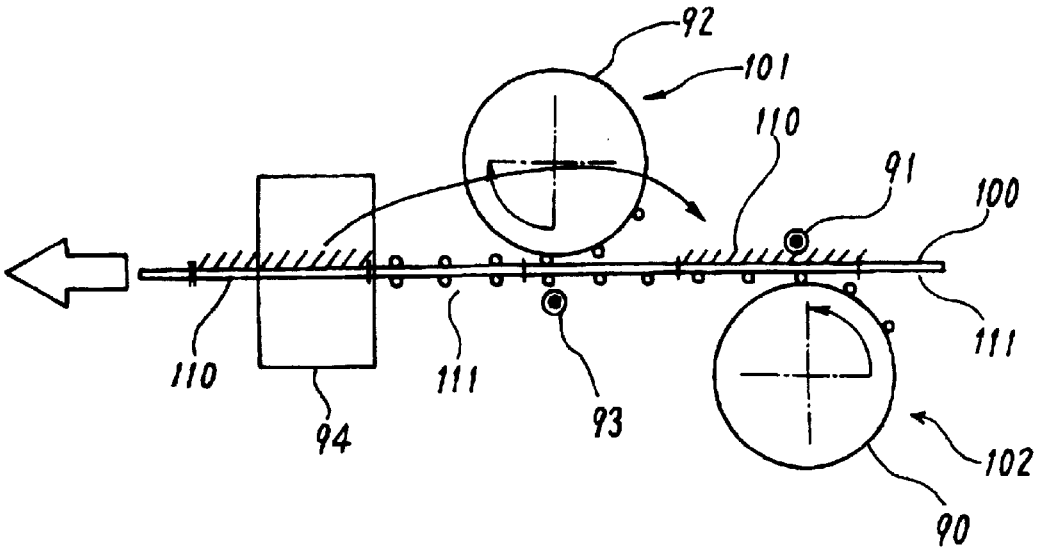
FIG. 33 PRIOR ART
FIG. 33 is a drawing explaining the prior art.
Figure 34:
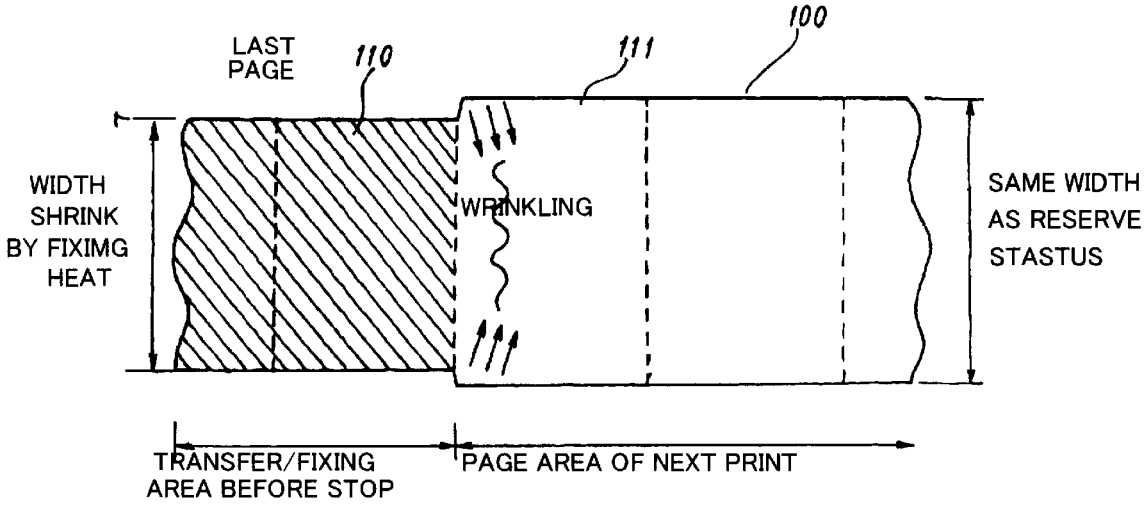
FIG. 34 is a drawing explaining the occurrence of wrinkling of the leading page in the prior art.

FIG. 32 is a schematic drawing of a printing device of another embodiment of the invention. This is a tandem-type color electronic photographic printer. The continuous paper 100 from the hopper 1 passes the color printing units 60 to 63, then is fixed by the fixation unit 50. The printing units 60 to 63 includes a photo-sensitive drum 64 and transfer roller 65. There is also a transfer belt 66.

In this case as well, at the end of a job the continuous paper 100 is fed backward in preparation for the next job. This invention can be applied to this kind of printer as well. Similarly, it can also be applied to a monochrome, single-side printing device.

In addition to the embodiments described above, the invention can be changed as described below.

(1) The printing mechanism explained was an electronic photographic printing mechanism, however another kind of printing mechanism that transfers a toner image is also possible.

(2) The fixation unit explained was a flash fixation unit, however, the other kind of fixation unit, such as a heat-roller fixation unit is also possible.

(3) The start and end of printing is shown as the start and end of a job, however other forms of the start and end of printing are possible.

The preferred embodiments of the present invention have been explained, however the invention is not limited to these embodiments and can be embodied in various forms within the scope of the present invention.

As explained above, this invention has the following effects.

(1) The moisture content of the final printing area and leading printing area of the continuous record medium is adjusted before printing, making it possible to reduce the difference between the amount of shrinkage of the final printing area and leading printing area, as well as reduce the occurrence of wrinkling of the leading area of the next printing instruction. In this way it is possible to prevent poor toner transfer to the beginning area of the next printing instruction.

(2) The wrinkle smoothing operation is executed selectively depending on the distribution of printing dots in the last printing area, and when there is no effect on toner transfer, it is possible to have a mode in which the wrinkle smoothing operation is not performed, thus making it possible to minimize any drop in the speed during high-speed printing.

What is claimed is:

1. A printing device for continuously printing on a continuous record medium and comprising:

a feed unit for feeding said record medium;

an image formation unit for transferring a toner image to said record medium;

a fixation unit for fixing the toner image to said record medium; and adjustment means for adjusting the amount of moisture of said record medium for reducing the difference in the amount of shrinkage between a final printing area of said record medium of a previous printing instruction and a next printing area following to said final printing area of said record medium.

2. The printing device of claim 1, wherein said adjustment means comprises:

a control unit for controlling said fixation unit such that fixation energy of said fixation unit at said final printing area is less than the fixation energy of printing areas other than said final printing area.

3. The printing device of claim 2, wherein said control unit controls said fixation unit such that fixation energy is applied to said final printing area at the start of the next printing instruction.

4. The printing device of claim 1, wherein said adjustment means comprises:

a control unit for controlling said feed unit such that said record medium is positioned at said image formation unit after the fixation energy is applied by said fixation unit to the next printing area following to said final printing area of said record medium.

5. The printing device of claim 1, wherein said fixation unit comprises a flash fixing unit.

6. The printing device of claim 1, wherein said adjustment means comprises:

a moisture-adjustment means for reducing the moisture content of said record medium of said next printing area.

7. The printing device of claim 6, wherein said moisture-adjustment means comprises a hot-air fan.

8. The printing device of claim 2, which further comprises:

a moisture-adjustment means for reducing the moisture content of said record medium of said next printing area.

9. The printing device of claim 1, which further comprises:

a selection-control unit for selectively operating said adjustment means.

10. The printing device of claim 9, wherein said selection-control unit comprises:

a selection-control unit for detecting the printing dot distribution in said final printing area, and selectively operating said adjustment means.

11. The printing device of claim 10, wherein said selection-control unit comprises:

a selection-control unit for detecting said printing dot distribution from printing data of said final printing area, and selectively operating said adjustment means.

12. A printing method for continuously printing a continuous record medium and which comprises:

an image formation step of transferring a toner image to said record medium by an image formation unit;

a fixation step of fixing the toner image on said record medium by a fixation unit;

a step of adjusting the moisture content of said record medium in order to reduce the difference in the amount of shrinkage between a final printing area of said record medium of a previous printing instruction and a next printing area following to said final printing area; and a step of positioning said next printing area at said image-formation unit after fixation of the final printing area of said previous printing instruction has been completed.

13. The printing method of claim 12, wherein said adjustment step comprises a step of controlling said fixation unit such that fixation energy of said fixation unit at said final printing area is less than the fixation energy of printing areas other than said final printing area.

14. The printing method of claim 13, wherein said adjustment step further comprises a step of controlling said fixation unit such that fixation energy is applied to said final printing area at the start of the next printing instruction.

15. The printing method of claim 12, wherein said adjustment step comprises a step of controlling said feed unit such that said record medium is positioned at said image formation unit after the fixation energy is applied by said fixation unit to the next printing area following to said final printing area of said record medium.

16. The printing method of claim 12, wherein said adjustment step comprises a step of moisture-adjustment for reducing the moisture content of said record medium of said next printing area.

17. The printing method of claim 12, wherein further comprises:

a step of selectively operating said adjustment step.

18. The printing method of claim 17, wherein said selective operation step comprises:

a step of detecting the printing dot distribution in said final printing area, and a step of selectively operating said adjustment step.

19. The printing method of claim 18, wherein said detecting step comprises:

a step of detecting said printing dot distribution from printing data of said final printing area.

* * * * *